US009330598B2

(12) United States Patent
Nathan et al.

(10) Patent No.: US 9,330,598 B2
(45) Date of Patent: May 3, 2016

(54) METHOD AND SYSTEM FOR DRIVING A LIGHT EMITTING DEVICE DISPLAY

(71) Applicant: Ignis Innovation Inc., Waterloo (CA)

(72) Inventors: Arokia Nathan, Cambridge (GB); Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days.

(21) Appl. No.: 14/481,370

(22) Filed: Sep. 9, 2014

(65) Prior Publication Data

US 2014/0375705 A1 Dec. 25, 2014

Related U.S. Application Data

(63) Continuation of application No. 12/893,148, filed on Sep. 29, 2010, now Pat. No. 8,860,636, which is a continuation of application No. 11/449,487, filed on Jun. 8, 2006, now Pat. No. 7,852,298.

(30) Foreign Application Priority Data

| | | |
|---|---|---|
| Jun. 8, 2005 | (CA) | 2508972 |
| Feb. 20, 2006 | (CA) | 2537173 |
| Apr. 10, 2006 | (CA) | 2542678 |

(51) Int. Cl.
*G09G 5/02* (2006.01)
*G09G 3/32* (2016.01)

(52) U.S. Cl.
CPC ..... *G09G 3/3233* (2013.01); *G09G 3/3258* (2013.01); *G09G 2300/043* (2013.01); *G09G 2300/0819* (2013.01); *G09G 2300/0842* (2013.01); *G09G 2300/0852* (2013.01); *G09G 2310/0216* (2013.01); *G09G 2310/0218* (2013.01); *G09G 2310/0221* (2013.01); *G09G 2310/0283* (2013.01);
(Continued)

(58) Field of Classification Search
USPC ..... 345/77, 212, 694
See application file for complete search history.

(56) References Cited

U.S. PATENT DOCUMENTS

| | | | |
|---|---|---|---|
| 3,506,851 | A | 4/1970 | Polkinghorn et al. |
| 3,750,987 | A | 8/1973 | Gobel |
| 3,774,055 | A | 11/1973 | Bapat et al. |

(Continued)

FOREIGN PATENT DOCUMENTS

| | | |
|---|---|---|
| AU | 729652 | 6/1997 |
| AU | 764896 | 12/2001 |

(Continued)

OTHER PUBLICATIONS

Ahnood et al.: "Effect of threshold voltage instability on field effect mobility in thin film transistors deduced from constant current measurements"; dated Aug. 2009.

(Continued)

*Primary Examiner* — Jason Olson
*Assistant Examiner* — Sosina Abebe
(74) *Attorney, Agent, or Firm* — Nixon Peabody LLP

(57) ABSTRACT

A method and system for driving a light emitting device display is provided. The system provides a timing schedule which increases accuracy in the display. The system may provide the timing schedule by which an operation cycle is implemented consecutively in a group of rows. The system may provide the timing schedule by which an aging factor is used for a plurality of frames.

20 Claims, 22 Drawing Sheets

(52) U.S. Cl.
CPC . *G09G 2320/0233* (2013.01); *G09G 2320/043* (2013.01); *G09G 2320/045* (2013.01); *G09G 2330/021* (2013.01)

(56) References Cited

U.S. PATENT DOCUMENTS

| | | | |
|---|---|---|---|
| 4,090,096 | A | 5/1978 | Nagami |
| 4,354,162 | A | 10/1982 | Wright |
| 4,996,523 | A | 2/1991 | Bell et al. |
| 5,134,387 | A | 7/1992 | Smith et al. |
| 5,153,420 | A | 10/1992 | Hack et al. |
| 5,170,158 | A | 12/1992 | Shinya |
| 5,204,661 | A | 4/1993 | Hack et al. |
| 5,266,515 | A | 11/1993 | Robb et al. |
| 5,278,542 | A | 1/1994 | Smith et al. |
| 5,408,267 | A | 4/1995 | Main |
| 5,498,880 | A | 3/1996 | Lee et al. |
| 5,572,444 | A | 11/1996 | Lentz et al. |
| 5,589,847 | A | 12/1996 | Lewis |
| 5,619,033 | A | 4/1997 | Weisfield |
| 5,648,276 | A | 7/1997 | Hara et al. |
| 5,670,973 | A | 9/1997 | Bassetti et al. |
| 5,691,783 | A | 11/1997 | Numao et al. |
| 5,701,505 | A | 12/1997 | Yamashita et al. |
| 5,714,968 | A | 2/1998 | Ikeda |
| 5,744,824 | A | 4/1998 | Kousai et al. |
| 5,745,660 | A | 4/1998 | Kolpatzik et al. |
| 5,748,160 | A | 5/1998 | Shieh et al. |
| 5,758,129 | A | 5/1998 | Gray et al. |
| 5,835,376 | A | 11/1998 | Smith et al. |
| 5,870,071 | A | 2/1999 | Kawahata |
| 5,874,803 | A | 2/1999 | Garbuzov et al. |
| 5,880,582 | A | 3/1999 | Sawada |
| 5,903,248 | A | 5/1999 | Irwin |
| 5,917,280 | A | 6/1999 | Burrows et al. |
| 5,949,398 | A | 9/1999 | Kim |
| 5,952,789 | A | 9/1999 | Stewart et al. |
| 5,990,629 | A | 11/1999 | Yamada et al. |
| 6,023,259 | A | 2/2000 | Howard et al. |
| 6,069,365 | A | 5/2000 | Chow et al. |
| 6,091,203 | A | 7/2000 | Kawashima et al. |
| 6,097,360 | A | 8/2000 | Holloman |
| 6,100,868 | A | 8/2000 | Lee et al. |
| 6,144,222 | A | 11/2000 | Ho |
| 6,229,506 | B1 | 5/2001 | Dawson et al. |
| 6,229,508 | B1 | 5/2001 | Kane |
| 6,246,180 | B1 | 6/2001 | Nishigaki |
| 6,252,248 | B1 | 6/2001 | Sano et al. |
| 6,268,841 | B1 | 7/2001 | Cairns et al. |
| 6,288,696 | B1 | 9/2001 | Holloman |
| 6,307,322 | B1 | 10/2001 | Dawson et al. |
| 6,310,962 | B1 | 10/2001 | Chung et al. |
| 6,323,631 | B1 | 11/2001 | Juang |
| 6,333,729 | B1 | 12/2001 | Ha |
| 6,388,653 | B1 | 5/2002 | Goto et al. |
| 6,392,617 | B1 | 5/2002 | Gleason |
| 6,396,469 | B1 | 5/2002 | Miwa et al. |
| 6,414,661 | B1 | 7/2002 | Shen et al. |
| 6,417,614 | B1 | 7/2002 | Ronda et al. |
| 6,417,825 | B1 | 7/2002 | Stewart et al. |
| 6,430,496 | B1 | 8/2002 | Smith et al. |
| 6,433,488 | B1 | 8/2002 | Bu |
| 6,473,065 | B1 | 10/2002 | Fan |
| 6,475,845 | B2 | 11/2002 | Kimura |
| 6,501,098 | B2 | 12/2002 | Yamazaki |
| 6,501,466 | B1 | 12/2002 | Yamagishi et al. |
| 6,522,315 | B2 | 2/2003 | Ozawa et al. |
| 6,535,185 | B2 | 3/2003 | Kim et al. |
| 6,542,138 | B1 | 4/2003 | Shannon et al. |
| 6,559,839 | B1 | 5/2003 | Ueno et al. |
| 6,580,408 | B1 | 6/2003 | Bae et al. |
| 6,583,398 | B2 | 6/2003 | Harkin |
| 6,618,030 | B2 | 9/2003 | Kane et al. |
| 6,639,244 | B1 | 10/2003 | Yamazaki et al. |
| 6,680,580 | B1 | 1/2004 | Sung |
| 6,686,699 | B2 | 2/2004 | Yumoto |
| 6,690,000 | B1 | 2/2004 | Muramatsu et al. |
| 6,693,610 | B2 | 2/2004 | Shannon et al. |
| 6,694,248 | B2 | 2/2004 | Smith et al. |
| 6,697,057 | B2 | 2/2004 | Koyama et al. |
| 6,724,151 | B2 | 4/2004 | Yoo |
| 6,734,636 | B2 | 5/2004 | Sanford et al. |
| 6,753,655 | B2 | 6/2004 | Shih et al. |
| 6,753,834 | B2 | 6/2004 | Mikami et al. |
| 6,756,741 | B2 | 6/2004 | Li |
| 6,777,888 | B2 | 8/2004 | Kondo |
| 6,781,567 | B2 | 8/2004 | Kimura |
| 6,788,231 | B1 | 9/2004 | Hsueh |
| 6,809,706 | B2 | 10/2004 | Shimoda |
| 6,828,950 | B2 | 12/2004 | Koyama |
| 6,858,991 | B2 | 2/2005 | Miyazawa |
| 6,859,193 | B1 | 2/2005 | Yumoto |
| 6,876,346 | B2 | 4/2005 | Anzai et al. |
| 6,900,485 | B2 | 5/2005 | Lee |
| 6,903,734 | B2 | 6/2005 | Eu |
| 6,911,960 | B1 | 6/2005 | Yokoyama |
| 6,911,964 | B2 | 6/2005 | Lee et al. |
| 6,914,448 | B2 | 7/2005 | Jinno |
| 6,919,871 | B2 | 7/2005 | Kwon |
| 6,924,602 | B2 | 8/2005 | Komiya |
| 6,937,220 | B2 | 8/2005 | Kitaura et al. |
| 6,940,214 | B1 | 9/2005 | Komiya et al. |
| 6,954,194 | B2 | 10/2005 | Matsumoto et al. |
| 6,970,149 | B2 | 11/2005 | Chung et al. |
| 6,975,142 | B2 | 12/2005 | Azami et al. |
| 6,975,332 | B2 | 12/2005 | Arnold et al. |
| 6,995,519 | B2 | 2/2006 | Arnold et al. |
| 7,027,015 | B2 | 4/2006 | Booth, Jr. et al. |
| 7,034,793 | B2 | 4/2006 | Sekiya et al. |
| 7,038,392 | B2 | 5/2006 | Libsch et al. |
| 7,057,588 | B2 | 6/2006 | Asano et al. |
| 7,061,451 | B2 | 6/2006 | Kimura |
| 7,071,932 | B2 | 7/2006 | Libsch et al. |
| 7,106,285 | B2 | 9/2006 | Naugler |
| 7,112,820 | B2 | 9/2006 | Chang et al. |
| 7,113,864 | B2 | 9/2006 | Smith et al. |
| 7,122,835 | B1 | 10/2006 | Ikeda et al. |
| 7,129,914 | B2 | 10/2006 | Knapp et al. |
| 7,164,417 | B2 | 1/2007 | Cok |
| 7,199,768 | B2 | 4/2007 | Ono et al. |
| 7,224,332 | B2 | 5/2007 | Cok |
| 7,248,236 | B2 | 7/2007 | Nathan et al. |
| 7,259,737 | B2 | 8/2007 | Ono et al. |
| 7,262,753 | B2 | 8/2007 | Tanghe et al. |
| 7,274,363 | B2 | 9/2007 | Ishizuka et al. |
| 7,310,092 | B2 | 12/2007 | Imamura |
| 7,315,295 | B2 | 1/2008 | Kimura |
| 7,317,434 | B2 | 1/2008 | Lan et al. |
| 7,321,348 | B2 | 1/2008 | Cok et al. |
| 7,327,357 | B2 | 2/2008 | Jeong |
| 7,333,077 | B2 | 2/2008 | Koyama et al. |
| 7,343,243 | B2 | 3/2008 | Smith et al. |
| 7,414,600 | B2 | 8/2008 | Nathan et al. |
| 7,466,166 | B2 | 12/2008 | Date et al. |
| 7,495,501 | B2 | 2/2009 | Iwabuchi et al. |
| 7,502,000 | B2 | 3/2009 | Yuki et al. |
| 7,515,124 | B2 | 4/2009 | Yaguma et al. |
| 7,535,449 | B2 | 5/2009 | Miyazawa |
| 7,554,512 | B2 | 6/2009 | Steer |
| 7,569,849 | B2 | 8/2009 | Nathan et al. |
| 7,595,776 | B2 | 9/2009 | Hashimoto et al. |
| 7,604,718 | B2 | 10/2009 | Zhang et al. |
| 7,609,239 | B2 | 10/2009 | Chang |
| 7,612,745 | B2 | 11/2009 | Yumoto et al. |
| 7,619,594 | B2 | 11/2009 | Hu |
| 7,619,597 | B2 | 11/2009 | Nathan et al. |
| 7,639,211 | B2 | 12/2009 | Miyazawa |
| 7,683,899 | B2 | 3/2010 | Hirakata et al. |
| 7,688,289 | B2 | 3/2010 | Abe et al. |
| 7,760,162 | B2 | 7/2010 | Miyazawa |
| 7,808,008 | B2 | 10/2010 | Miyake |
| 7,852,298 | B2 | 12/2010 | Nathan et al. |
| 7,859,520 | B2 | 12/2010 | Kimura |
| 7,889,159 | B2 | 2/2011 | Nathan et al. |

(56) References Cited

U.S. PATENT DOCUMENTS 7,903,127 B2 3/2011 Kwon
7,920,116 B2 4/2011 Woo et al.
7,944,414 B2 5/2011 Shirasaki et al.
7,978,170 B2 7/2011 Park et al.
7,989,392 B2 8/2011 Crockett et al.
7,995,008 B2 8/2011 Miwa
8,063,852 B2 11/2011 Kwak et al.
8,102,343 B2 1/2012 Yatabe
8,144,081 B2 3/2012 Miyazawa
8,159,007 B2 4/2012 Bama et al.
8,242,979 B2 8/2012 Anzai et al.
8,253,665 B2 8/2012 Nathan et al.
8,319,712 B2 11/2012 Nathan et al.
8,405,582 B2 3/2013 Kim
8,816,946 B2 8/2014 Nathan et al.
8,860,636 B2 10/2014 Nathan et al.
2001/0002703 A1 6/2001 Koyama
2001/0009283 A1 7/2001 Arao et al.
2001/0026257 A1 10/2001 Kimura
2001/0030323 A1 10/2001 Ikeda
2001/0040541 A1 11/2001 Yoneda et al.
2001/0043173 A1 11/2001 Troutman
2001/0045929 A1 11/2001 Prache
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0030190 A1 3/2002 Ohtani et al.
2002/0047565 A1 4/2002 Nara et al.
2002/0052086 A1 5/2002 Maeda
2002/0080108 A1 6/2002 Wang
2002/0084463 A1 7/2002 Sanford et al.
2002/0101172 A1 8/2002 Bu
2002/0117722 A1 8/2002 Osada et al.
2002/0140712 A1 10/2002 Ouchi et al.
2002/0158587 A1 10/2002 Komiya
2002/0158666 A1 10/2002 Azami et al.
2002/0158823 A1 10/2002 Zavracky et al.
2002/0171613 A1 11/2002 Goto et al.
2002/0186214 A1 12/2002 Siwinski
2002/0190971 A1 12/2002 Nakamura et al.
2002/0195967 A1 12/2002 Kim et al.
2002/0195968 A1 12/2002 Sanford et al.
2003/0001828 A1 1/2003 Asano
2003/0020413 A1 1/2003 Oomura
2003/0030603 A1 2/2003 Shimoda
2003/0062524 A1 4/2003 Kimura
2003/0062844 A1 4/2003 Miyazawa
2003/0076048 A1 4/2003 Rutherford
2003/0090445 A1 5/2003 Chen et al.
2003/0090447 A1 5/2003 Kimura
2003/0090481 A1 5/2003 Kimura
2003/0095087 A1 5/2003 Libsch
2003/0098829 A1 5/2003 Chen et al.
2003/0107560 A1 6/2003 Yumoto et al.
2003/0107561 A1 6/2003 Uchino et al.
2003/0111966 A1 6/2003 Mikami et al.
2003/0112205 A1 6/2003 Yamada
2003/0112208 A1 6/2003 Okabe et al.
2003/0117348 A1 6/2003 Knapp et al.
2003/0122474 A1 7/2003 Lee
2003/0122747 A1 7/2003 Shannon et al.
2003/0128199 A1 7/2003 Kimura
2003/0151569 A1 8/2003 Lee et al.
2003/0156104 A1 8/2003 Morita
2003/0169241 A1 9/2003 LeChevalier
2003/0169247 A1 9/2003 Kawabe et al.
2003/0179626 A1 9/2003 Sanford et al.
2003/0189535 A1 10/2003 Matsumoto et al.
2003/0197663 A1 10/2003 Lee et al.
2003/0214465 A1 11/2003 Kimura
2003/0227262 A1 12/2003 Kwon
2003/0230141 A1 12/2003 Gilmour et al.
2003/0230980 A1 12/2003 Forrest et al.
2004/0004589 A1 1/2004 Shih
2004/0032382 A1 2/2004 Cok et al.
2004/0041750 A1 3/2004 Abe
2004/0066357 A1 4/2004 Kawasaki
2004/0070557 A1* 4/2004 Asano et al. ..... 345/76
2004/0129933 A1 7/2004 Nathan et al.
2004/0130516 A1 7/2004 Nathan et al.
2004/0135749 A1 7/2004 Kondakov et al.
2004/0145547 A1 7/2004 Oh
2004/0150595 A1 8/2004 Kasai
2004/0155841 A1 8/2004 Kasai
2004/0174349 A1 9/2004 Libsch et al.
2004/0174354 A1 9/2004 Ono
2004/0183759 A1 9/2004 Stevenson et al.
2004/0189627 A1 9/2004 Shirasaki et al.
2004/0196275 A1 10/2004 Hattori
2004/0227697 A1 11/2004 Mori
2004/0239696 A1 12/2004 Okabe
2004/0251844 A1 12/2004 Hashido et al.
2004/0252085 A1 12/2004 Miyagawa
2004/0252089 A1 12/2004 Ono et al.
2004/0256617 A1 12/2004 Yamada et al.
2004/0257353 A1 12/2004 Imamura et al.
2004/0257355 A1 12/2004 Naugler
2004/0263437 A1 12/2004 Hattori
2005/0007357 A1 1/2005 Yamashita et al.
2005/0052379 A1 3/2005 Waterman
2005/0057459 A1 3/2005 Miyazawa
2005/0067970 A1 3/2005 Libsch et al.
2005/0067971 A1 3/2005 Kane
2005/0083270 A1 4/2005 Miyazawa
2005/0110420 A1 5/2005 Arnold et al.
2005/0110727 A1 5/2005 Shin
2005/0123193 A1 6/2005 Lamberg et al.
2005/0140610 A1 6/2005 Smith et al.
2005/0145891 A1 7/2005 Abe
2005/0156831 A1 7/2005 Yamazaki et al.
2005/0168416 A1 8/2005 Hashimoto et al.
2005/0206590 A1 9/2005 Sasaki et al.
2005/0219188 A1 10/2005 Kawabe et al.
2005/0243037 A1 11/2005 Eom et al.
2005/0248515 A1 11/2005 Naugler et al.
2005/0258867 A1 11/2005 Miyazawa
2005/0285825 A1 12/2005 Eom et al.
2006/0007072 A1 1/2006 Choi et al.
2006/0012311 A1 1/2006 Ogawa
2006/0038750 A1 2/2006 Inoue et al.
2006/0038758 A1 2/2006 Routley et al.
2006/0038762 A1 2/2006 Chou
2006/0066533 A1 3/2006 Sato et al.
2006/0077077 A1 4/2006 Kwon
2006/0077134 A1 4/2006 Hector et al.
2006/0092185 A1 5/2006 Jo et al.
2006/0125408 A1 6/2006 Nathan et al.
2006/0125740 A1* 6/2006 Shirasaki et al. ..... 345/77
2006/0139253 A1 6/2006 Choi et al.
2006/0145964 A1 7/2006 Park et al.
2006/0191178 A1 8/2006 Sempel et al.
2006/0209012 A1 9/2006 Hagood, IV
2006/0214888 A1 9/2006 Schneider et al.
2006/0221009 A1 10/2006 Miwa
2006/0227082 A1 10/2006 Ogata et al.
2006/0232522 A1 10/2006 Roy et al.
2006/0244391 A1 11/2006 Shishido et al.
2006/0244697 A1 11/2006 Lee et al.
2006/0261841 A1 11/2006 Fish
2006/0290614 A1 12/2006 Nathan et al.
2007/0001939 A1 1/2007 Hashimoto et al.
2007/0001945 A1 1/2007 Yoshida et al.
2007/0008251 A1 1/2007 Kohno et al.
2007/0008297 A1 1/2007 Bassetti
2007/0035489 A1 2/2007 Lee
2007/0035707 A1 2/2007 Margulis
2007/0040773 A1 2/2007 Lee et al.
2007/0040782 A1 2/2007 Woo et al.
2007/0063932 A1 3/2007 Nathan et al.
2007/0080908 A1 4/2007 Nathan et al.
2007/0085801 A1 4/2007 Park et al.
2007/0109232 A1 5/2007 Yamamoto et al.

(56) References Cited

U.S. PATENT DOCUMENTS

| | | | |
|---|---|---|---|
| 2007/0128583 | A1 | 6/2007 | Miyazawa |
| 2007/0164941 | A1 | 7/2007 | Park et al. |
| 2007/0182671 | A1 | 8/2007 | Nathan et al. |
| 2007/0236430 | A1 | 10/2007 | Fish |
| 2007/0241999 | A1 | 10/2007 | Lin |
| 2007/0242008 | A1 | 10/2007 | Cummings |
| 2008/0001544 | A1 | 1/2008 | Murakami et al. |
| 2008/0043044 | A1 | 2/2008 | Woo et al. |
| 2008/0048951 | A1 | 2/2008 | Naugler et al. |
| 2008/0055134 | A1 | 3/2008 | Li et al. |
| 2008/0074360 | A1 | 3/2008 | Lu et al. |
| 2008/0088549 | A1 | 4/2008 | Nathan et al. |
| 2008/0094426 | A1 | 4/2008 | Kimpe |
| 2008/0122819 | A1 | 5/2008 | Cho et al. |
| 2008/0129906 | A1 | 6/2008 | Lin et al. |
| 2008/0228562 | A1 | 9/2008 | Smith et al. |
| 2008/0231641 | A1 | 9/2008 | Miyashita |
| 2008/0265786 | A1 | 10/2008 | Koyama |
| 2008/0290805 | A1 | 11/2008 | Yamada et al. |
| 2008/0315788 | A1 | 12/2008 | Levey |
| 2009/0009459 | A1 | 1/2009 | Miyashita |
| 2009/0015532 | A1 | 1/2009 | Katayama et al. |
| 2009/0058789 | A1 | 3/2009 | Hung et al. |
| 2009/0121988 | A1 | 5/2009 | Amo et al. |
| 2009/0146926 | A1 | 6/2009 | Sung et al. |
| 2009/0153448 | A1 | 6/2009 | Tomida et al. |
| 2009/0153459 | A9 | 6/2009 | Han et al. |
| 2009/0174628 | A1 | 7/2009 | Wang et al. |
| 2009/0201230 | A1 | 8/2009 | Smith |
| 2009/0201281 | A1 | 8/2009 | Routley et al. |
| 2009/0251486 | A1 | 10/2009 | Sakakibara et al. |
| 2009/0278777 | A1 | 11/2009 | Wang et al. |
| 2009/0289964 | A1 | 11/2009 | Miyachi |
| 2009/0295423 | A1 | 12/2009 | Levey |
| 2010/0039451 | A1 | 2/2010 | Jung |
| 2010/0039453 | A1 | 2/2010 | Nathan et al. |
| 2010/0103082 | A1 | 4/2010 | Levey |
| 2010/0103159 | A1 | 4/2010 | Leon |
| 2010/0207920 | A1 | 8/2010 | Chaji et al. |
| 2010/0225634 | A1 | 9/2010 | Levey et al. |
| 2010/0251295 | A1 | 9/2010 | Amento et al. |
| 2010/0269889 | A1 | 10/2010 | Reinhold et al. |
| 2010/0277400 | A1 | 11/2010 | Jeong |
| 2010/0315319 | A1 | 12/2010 | Cok et al. |
| 2011/0050741 | A1 | 3/2011 | Jeong |
| 2011/0069089 | A1 | 3/2011 | Kopf et al. |
| 2011/0205250 | A1 | 8/2011 | Yoo et al. |
| 2011/0260172 | A1 | 10/2011 | Koyama |
| 2012/0299976 | A1 | 11/2012 | Chen et al. |
| 2012/0299978 | A1 | 11/2012 | Chaji |
| 2014/0252988 | A1 | 9/2014 | Azizi et al. |

FOREIGN PATENT DOCUMENTS

| | | | |
|---|---|---|---|
| CA | 1 294 034 | | 1/1992 |
| CA | 2 249 592 | | 7/1998 |
| CA | 2 303 302 | | 3/1999 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 507 276 | | 8/2002 |
| CA | 2 463 653 | | 1/2004 |
| CA | 2 498 136 | | 3/2004 |
| CA | 2 522 396 | | 11/2004 |
| CA | 2 438 363 | | 2/2005 |
| CA | 2 443 206 | | 3/2005 |
| CA | 2 519 097 | | 3/2005 |
| CA | 2 472 671 | | 12/2005 |
| CA | 2 523 841 | | 1/2006 |
| CA | 2 567 076 | | 1/2006 |
| CA | 2 495 726 | | 7/2006 |
| CA | 2 557 713 | | 11/2006 |
| CA | 2 526 782 | C | 8/2007 |
| CA | 2 651 893 | | 11/2007 |
| CA | 2 672 590 | | 10/2009 |
| CN | 1302451 | C | 9/2003 |
| CN | 1490779 | A | 4/2004 |
| CN | 1560671 | A | 1/2005 |
| CN | 1601594 | A | 3/2005 |
| CN | 1886774 | | 12/2006 |
| CN | 101228569 | B | 7/2008 |
| CN | 102663977 | A | 9/2012 |
| CN | 104036719 | | 9/2014 |
| DE | 202006007613 | | 9/2006 |
| EP | 0 478 186 | A2 | 4/1992 |
| EP | 1 028 471 | A | 8/2000 |
| EP | 1 130 565 | A1 | 9/2001 |
| EP | 1 194 013 | | 4/2002 |
| EP | 0 925 588 | | 11/2002 |
| EP | 1 321 922 | | 6/2003 |
| EP | 1 335 430 | A1 | 8/2003 |
| EP | 1 381 019 | | 1/2004 |
| EP | 1 429 312 | A | 6/2004 |
| EP | 1 439 520 | A2 | 7/2004 |
| EP | 1 465 143 | A | 10/2004 |
| EP | 1 473 689 | A | 11/2004 |
| EP | 1 517 290 | A2 | 3/2005 |
| EP | 1 521 203 | A2 | 4/2005 |
| EP | 2 133 860 | A1 | 12/2009 |
| EP | 2 383 720 | A2 | 11/2011 |
| GB | 2 399 935 | | 9/2004 |
| GB | 2 460 018 | | 11/2009 |
| JP | 09 090405 | | 4/1997 |
| JP | 10-254410 | | 9/1998 |
| JP | 11 231805 | | 8/1999 |
| JP | 2001-005426 | | 1/2001 |
| JP | 2002-278513 | | 9/2002 |
| JP | 2003-076331 | | 3/2003 |
| JP | 2003-099000 | | 4/2003 |
| JP | 2003-173165 | | 6/2003 |
| JP | 2003-186439 | | 7/2003 |
| JP | 2003-195809 | | 7/2003 |
| JP | 2003-271095 | | 9/2003 |
| JP | 2003-308046 | | 10/2003 |
| JP | 2004-054188 | | 2/2004 |
| JP | 2004-133240 | A | 4/2004 |
| JP | 2004-226960 | | 8/2004 |
| JP | 2004-280059 | A | 10/2004 |
| JP | 2004-341359 | A | 12/2004 |
| JP | 2005-004147 | | 1/2005 |
| JP | 2005-099715 | | 4/2005 |
| JP | 2005-258326 | | 9/2005 |
| JP | 2005-338819 | | 12/2005 |
| JP | 2007-155754 | A | 6/2007 |
| JP | 2013-190829 | | 9/2013 |
| JP | 5355080 | | 11/2013 |
| JP | 2014-194582 | | 10/2014 |
| TW | 569173 | | 1/2004 |
| TW | 200526065 | | 8/2005 |
| TW | 1239501 | | 9/2005 |
| WO | WO 98/11554 | | 3/1998 |
| WO | WO 99/48079 | | 9/1999 |
| WO | WO 01/27910 | A1 | 4/2001 |
| WO | WO 02/067327 | A | 8/2002 |
| WO | WO 03/034389 | | 4/2003 |
| WO | WO 03/063124 | | 7/2003 |
| WO | WO 03/075256 | | 9/2003 |
| WO | WO 2004/003877 | | 1/2004 |
| WO | WO 2004/015668 | A1 | 2/2004 |
| WO | WO 2004/034364 | | 4/2004 |
| WO | WO 2005/022498 | | 3/2005 |
| WO | WO 2005/055185 | | 6/2005 |
| WO | WO 2005/055186 | A1 | 6/2005 |
| WO | WO 2005/069267 | | 7/2005 |
| WO | WO 2005/122121 | | 12/2005 |
| WO | WO 2006/063448 | | 6/2006 |
| WO | WO 2006/128069 | | 11/2006 |
| WO | WO 2008/057369 | | 5/2008 |
| WO | WO 2008/290805 | | 11/2008 |
| WO | WO 2009/059028 | | 5/2009 |

(56) References Cited

FOREIGN PATENT DOCUMENTS

| | | |
|---|---|---|
| WO | WO 2009/127065 | 10/2009 |
| WO | WO 2010/066030 | 6/2010 |
| WO | WO 2010/120733 | 10/2010 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation Inspection and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated May 2008 (177 pages).
Chapter 3: Color Spaces Keith Jack:Video Demystified: "A Handbook for the Digital Engineer" 2001 Referex ORD-0000-00-00 USA EP040425529 ISBN: 1-878707-56-6 pp. 32-33.
Chapter 8: Alternative Flat Panel Display 1-25 Technologies; Willem den Boer: "Active Matrix Liquid Crystal Display: Fundamentals and Applications" 2005 Referex ORD-0000-00-00 U.K.; XP040426102 ISBN: 0-7506-7813-5 pp. 206-209 p. 208.
European Partial Search Report Application No. 12 15 6251.6 European Patent Office dated May 30, 2012 (7 pages).
European Patent Office Communication Application No. 05 82 1114 dated Jan. 11, 2013 (9 pages).
European Patent Office Communication with Supplemental European Search Report for EP Application No. 07 70 1644.2, dated Aug. 18, 2009 (12 pages).
European Search Report Application No. 10 83 4294.0-1903 dated Apr. 8, 2013 (9 pages).
European Search Report Application No. EP 05 80 7905 dated Mar. 18, 2009 (5 pages).
European Search Report Application No. EP 05 82 1114 dated Mar. 27, 2009 (2 pages).
European Search Report Application No. EP 07 70 1644 dated Aug. 5, 2009 (5 pages).
European Search Report Application No. EP 10 17 5764—dated Oct. 18, 2010 (11 pages).
European Search Report Application No. EP 10 82 9593.2—European Patent Office dated May 17, 2013 (7 pages).
European Search Report Application No. EP 12 15 6251.6 European Patent Office dated Oct. 12, 2012 (18 pages).
European Search Report Application No. EP. 11 175 225.9 dated Nov. 4, 2011 (10 pages).
European Supplementary Search Report Application No. EP 09 80 2309 dated May 8, 2011 (14 pages).
European Supplementary Search Report Application No. EP 09 83 1339.8 dated Mar. 26, 2012 (11 pages).
Extended European Search Report Application No. EP 06 75 2777.0-1228 dated Dec. 3, 2010 (21 pages).
Extended European Search Report Application No. EP 09 73 2338.0 dated May 24, 2011 (9 pages).
Extended European Search Report Application No. EP 11 17 5223., 4 mailed Nov. 8, 2011 (8 pages).
Extended European Search Report Application No. EP 12 17 4465.0 European Patent Office dated Sep. 7, 2012 (9 pages).
Fan et al. "LTPS_TFT Pixel Circuit Compensation for TFT Threshold Voltage Shift and IR-Drop on the Power Line for Amolded Displays" 5 pages copyright 2012.
Goh et al. "A New a-Si:H Thin-Film Transistor Pixel Circuit for Active-Matrix Organic Light-Emitting Diodes" IEEE Electron Device Letters vol. 24 No. 9 Sep. 2003 pp. 583-585.
International Search Report Application No. PCT/CA2005/001844 dated Mar. 28, 2006 (2 pages).
International Search Report Application No. PCT/CA2006/000941 dated Oct. 3, 2006 (2 pages).
International Search Report Application No. PCT/CA2007/000013 dated May 7, 2007 (2 pages).
International Search Report Application No. PCT/CA2009/001049 mailed Dec. 7, 2009 (4 pages).
International Search Report corresponding to International Patent Application No. PCT/IB2010/002898, Canadian Intellectual Property Office, dated Jul. 28, 2009 (5 pages).
International Search Report Application No. PCT/CA2009/001769 dated Apr. 8, 2010 (8 pages).
International Search Report Application No. PCT/IB2010/002898 Canadian Intellectual Property Office dated Mar. 30, 2011 (5 pages).

(56) References Cited

OTHER PUBLICATIONS

International Search Report Application No. PCT/IB2010/055481 dated Apr. 7, 2011 (3 pages).
International Search Report Application No. PCT/IB2011/051103 dated Jul. 8, 2011 2 pages.
International Search Report Application No. PCT/IB2012/052651 5 pages dated Sep. 11, 2012.
International Searching Authority Written Opinion Application No. PCT/IB2010/055481, dated Apr. 7, 2011 (6 pages).
International Searching Authority Written Opinion Application No. PCT/IB2012/052651 6 pages dated Sep. 11, 2012.
International Searching Authority Written Opinion Application No. PCT/IB2011/051103, dated Jul. 8, 2011, 6 pages.
International Searching Authority Written Opinion Application No. PCT/CA2009/001769, dated Apr. 8, 2010 (8 pages).
Jafarabadiashtiani et al.: "A New Driving Method for a-Si AMOLED Displays Based on Voltage Feedback"; dated May 2005 (4 pages).
Joon-Chul Goh, et al., "A New a-Si:H Thin-Film Transistor Pixel Circuit for Active-Matrix Organic Light-Emitting Diodes," *IEEE Electron Device Letters*, vol. 24, No. 9, Sep. 2003, pp. 583-585 (3 pages).
Lee et al.: "Ambipolar Thin-Film Transistors Fabricated by PECVD Nanocrystalline Silicon"; dated May 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto Sep. 15-19, 1997 (6 pages).
Matsueda y et al.: "35.1: 2.5-in. AMOLED with Integrated 6-bit Gamma Compensated Digital Data Driver"; dated May 2004 (4 pages).
Nathan et al., "Amorphous Silicon Thin Film Transistor Circuit Integration for Organic LED Displays on Glass and Plastic" *IEEE Journal of Solid-State Circuits*, vol. 39, No. 9, Sep. 2004, pp. 1477-1486.
Nathan et al.: "Backplane Requirements for Active Matrix Organic Light Emitting Diode Displays"; dated Sep. 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a -Si for AMOLED—Meeting the Performance and Cost Demands of Display Applications (Cell Phone to HDTV)"; dated Jun. 2006 (4 pages).
Nathan et al.: "Thin film imaging technology on glass and plastic"; dated Oct. 31-Nov. 2, 2000 (4 pages).
Ono et al. "Shared Pixel Compensation Circuit for AM-OLED Displays" Proceedings of the 9$^{th}$ Asian Symposium on Information Display (ASID) pp. 462-465 New Delhi dated Oct. 8-12, 2006 (4 pages).
Philipp: "Charge transfer sensing" Sensor Review vol. 19 No. 2 Dec. 31, 1999 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Smith, Lindsay I., "A tutorial on Principal Components Analysis," dated Feb. 26, 2001 (27 pages).
Stewart M. et al. "Polysilicon TFT technology for active matrix OLED displays" IEEE transactions on electron devices vol. 48 No. 5 May 2001 (7 pages).
Vygranenko et al.: "Stability of indium-oxide thin-film transistors by reactive ion beam assisted deposition"; dated Feb. 2009.
Wang et al.: "Indium oxides by reactive ion beam assisted evaporation: From material study to device application," dated Mar. 2009 (6 pages).
Yi He et al. "Current-Source a-Si:H Thin Film Transistor Circuit for Active-Matrix Organic Light-Emitting Displays" IEEE Electron Device Letters vol. 21 No. 12 Dec. 2000 pp. 590-592.
International Search Report Application No. PCT/IB2013/059074, dated Dec. 18, 2013 (5 pages).
International Searching Authority Written Opinion Application No. PCT/IB2013/059074, dated Dec. 18, 2013 (8 pages ).
International Search Report Application No. 14157112.5-1903, dated Aug. 21, 2014 (7 pages).
Japanese Office Action corresponding to co-pending Japanese Patent Application Serial No. 2014-133475, Japanese Patent Office, dated Jun. 30, 3015; (6 pages).

* cited by examiner

METHOD AND SYSTEM FOR DRIVING A LIGHT EMITTING DEVICE DISPLAY

CROSS REFERENCE TO RELATED APPLICATIONS

This application is a continuation of U.S. patent application Ser. No. 12/893,148, filed Sep. 29, 2010, now allowed, which is a continuation of U.S. patent application Ser. No. 11/449,487, filed Jun. 8, 2006, now U.S. Pat. No. 7,852,298, which claims priority to Canadian Patent No. 2,508,972, filed Jun. 8, 2005, and Canadian Patent No. 2,537,173, filed Feb. 20, 2006, and Canadian Patent No. 2,542,678, filed Apr. 10, 2006, all of which are hereby incorporated by reference in their entireties.

FIELD OF INVENTION

The present invention relates to display technologies, more specifically a method and system for driving light emitting device displays.

BACKGROUND OF THE INVENTION

Recently active-matrix organic light-emitting diode (AMOLED) displays with amorphous silicon (a-Si), polysilicon, organic, or other driving backplane have become more attractive due to advantages over active matrix liquid crystal displays. An AMOLED display using a-Si backplanes, for example, has the advantages that include low temperature fabrication that broadens the use of different substrates and makes flexible displays feasible, and its low cost fabrication. Also, OLED yields high resolution displays with a wide viewing angle.

The AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

FIG. 1 illustrates conventional operation cycles for a conventional voltage-programmed AMOLED display. In FIG. 1, "Rowi" (i=1, 2, 3) represents a ith row of the matrix pixel array of the AMOLED display. In FIG. 1, "C" represents a compensation voltage generation cycle in which a compensation voltage is developed across the gate-source terminal of a drive transistor of the pixel circuit, "VT-GEN" represents a $V_T$-generation cycle in which the threshold voltage of the drive transistor, $V_T$, is generated, "P" represents a current-regulation cycle where the pixel current is regulated by applying a programming voltage to the gate of the drive transistor, and "D" represents a driving cycle in which the OLED of the pixel circuit is driven by current controlled by the drive transistor.

For each row of the AMOLED display, the operating cycles include the compensation voltage generation cycle "C", the $V_T$-generation cycle "VT-GEN", the current-regulation cycle "P", and the driving cycle "D". Typically, these operating cycles are performed sequentially for a matrix structure, as shown in FIG. 1. For example, the entire programming cycles (i.e., "C", "VT-GEN", and "P") of the first row (i.e., $Row_1$) are executed, and then the second row (i.e., $Row_2$) is programmed.

However, since the $V_T$-generation cycle "VT-GEN" requires a large timing budget to generate an accurate threshold voltage of a drive TFT, this timing schedule cannot be adopted in large-area displays. Moreover, executing two extra operating cycles (i.e., "C" and "VT-GEN") results in higher power consumption and also requires extra controlling signals leading to higher implementation cost.

SUMMARY OF THE INVENTION

It is an object of the invention to provide a method and system that obviates or mitigates at least one of the disadvantages of existing systems.

In accordance with an aspect of the present invention there is provided a display system which includes: a pixel array including a plurality of pixel circuits arranged in row and column. The pixel circuit has a light emitting device, a capacitor, a switch transistor and a drive transistor for driving the light emitting device. The pixel circuit includes a path for programming, and a second path for generating the threshold of the drive transistor. The system includes: a first driver for providing data for the programming to the pixel array; and a second driver for controlling the generation of the threshold of the drive transistor for one or more drive transistors. The first driver and the second driver drives the pixel array to implement the programming and generation operations independently.

In accordance with a further aspect of the present invention there is provided a method of driving a display system. The display system includes: a pixel array including a plurality of pixel circuits arranged in row and column. The pixel circuit has a light emitting device, a capacitor, a switch transistor and a drive transistor for driving the light emitting device. The pixel circuit includes a path for programming, and a second path for generating the threshold of the drive transistor. The method includes the steps of: controlling the generation of the threshold of the drive transistor for one or more drive transistors, providing data for the programming to the pixel array, independently from the step of controlling.

In accordance with a further aspect of the present invention there is provided a display system which includes: a pixel array including a plurality of pixel circuits arranged in row and column, The pixel circuit has a light emitting device, a capacitor, a switch transistor and a drive transistor for driving the light emitting device. The system includes: a first driver for providing data to the pixel array for programming; and a second driver for generating and storing an aging factor of each pixel circuit in a row into the corresponding pixel circuit, and programming and driving the pixel circuit in the row for a plurality of frames based on the stored aging factor. The pixel array is divided into a plurality of segments. At least one of signal lines driven by the second driver for generating the aging factor is shared in a segment.

In accordance with a further aspect of the present invention there is provided a method of driving a display system. The display system includes: a pixel array including a plurality of pixel circuits arranged in row and column. The pixel circuit has a light emitting device, a capacitor, a switch transistor and a drive transistor for driving the light emitting device. The pixel array is divided into a plurality of segments. The method includes the steps of: generating an aging factor of each pixel circuit using a segment signal and storing the aging factor into the corresponding pixel circuit for each row, the segment signal being shared by each segment; and programming and driving the pixel circuit in the row for a plurality of frames based on the stored aging factor.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Embodiments of the present invention are described using a pixel circuit having a light emitting device, such as an organic light emitting diode (OLED), and a plurality of transistors, such as thin film transistors (TFTs), arranged in row and column, which form an AMOLED display. The pixel circuit may include a pixel driver for OLED. However, the pixel may include any light emitting device other than OLED, and the pixel may include any transistors other than TFTs. The transistors in the pixel circuit may be n-type transistors, p-type transistors or combinations thereof. The transistors in the pixel may be fabricated using amorphous silicon, nano/micro crystalline silicon, poly silicon, organic semiconductors technologies (e.g. organic TFT), NMOS/PMOS technology or CMOS technology (e.g. MOSFET). In the description, "pixel circuit" and "pixel" may be used interchangeably. The pixel circuit may be a current-programmed pixel or a voltage-programmed pixel. In the description below, "signal" and "line" may be used interchangeably.

The embodiments of the present invention involve a technique for generating an accurate threshold voltage of a drive TFT. As a result, it generates a stable current despite the shift of the characteristics of pixel elements due to, for example, the pixel aging, and process variation. It enhances the brightness stability of the OLED. Also it may reduce the power consumption and signals, resulting in low implementation cost.

A segmented timing schedule and a parallel timing schedule are described in detail. These schedules extend the timing budget of a cycle for generating the threshold voltage $V_T$ of a drive transistor. As described below, the rows in a display array are segmented and the operating cycles are divided into a plurality of categories, e.g., two categories. For example, the first category includes a compensation cycle and a $V_T$-generation cycle, while the second category includes a current-regulation cycle and a driving cycle. The operating cycles for each category are performed sequentially for each segment, while the two categories are executed for two adjacent segments. For example, while the current regulation and driving cycles are performed for the first segment sequentially, the compensation and $V_T$-generation cycles are executed for the second segment.

Figure 1:
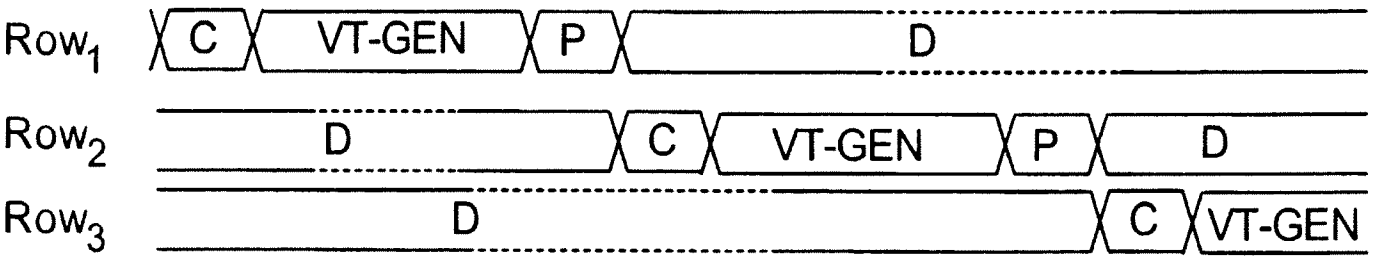
FIG. 1 illustrates conventional operating cycles for a conventional AMOLED display.
Figure 2:
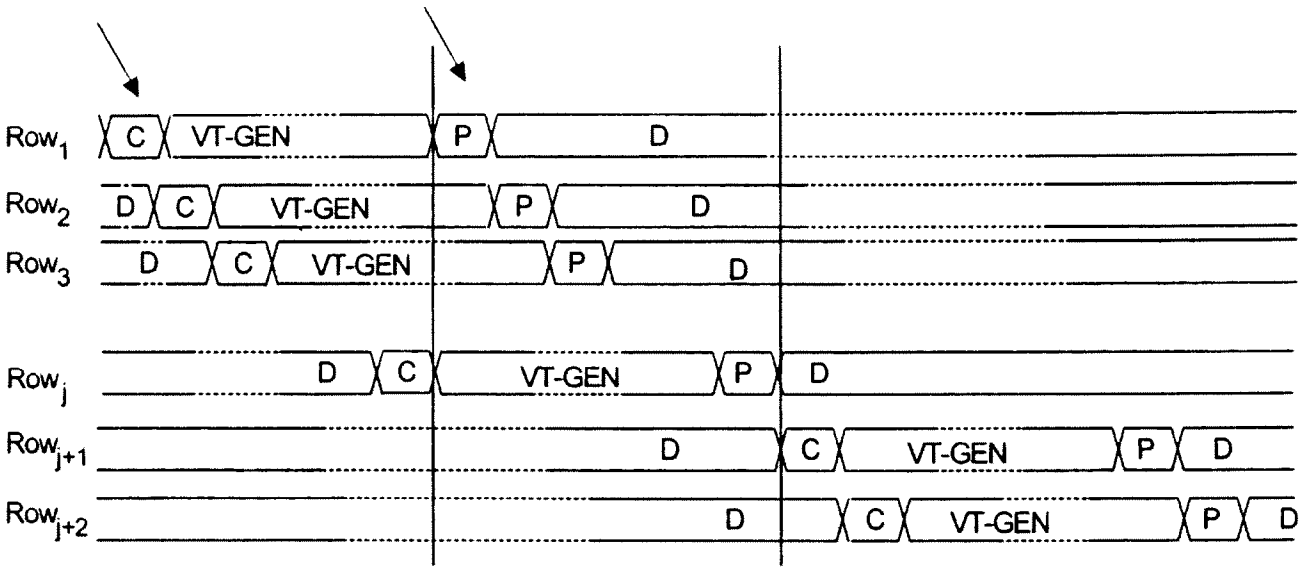
FIG. 2 illustrates an example of a segmented timing schedule for stable operation of a light emitting light display, in accordance with an embodiment of the present invention.

FIG. 2 illustrates an example of the segmented timing schedule for stable operation of a light emitting display, in accordance with an embodiment of the present invention. In FIG. 2, "$Row_k$" (k=1, 2, 3, . . . , j, j+1, j+2) represents a kth row of a display array, an arrow shows an execution direction.

For each row, the timing schedule of FIG. 2 includes a compensation voltage generation cycle "C", a $V_T$-generation cycle "VT-GEN", a current-regulation cycle "D", and a driving cycle "P".

The timing schedule of FIG. 2 extends the timing budget of the $V_T$-generation cycle "VT-GEN" without affecting the programming time. To achieve this, the rows of the display array to which the segmented addressing scheme of FIG. 2 is applied are categorized as few segments. Each segment includes rows in which the $V_T$-generation cycle is carried out consequently. In FIG. 2, $Row_1$, $Row_2$, $Row_3$, . . . , and, $Row_j$ are in one segment in a plurality of rows of the display array.

The programming of each segment starts with executing the first and second operating cycles "C" and "VT-GEN". After that, the current-calibration cycle "P" is preformed for the entire segment. As a result, the timing budget of the $V_T$-generation cycle "VT-GEN" is extended to j. $\tau_P$ where j is the number of rows in each segment, and $\tau_P$ is the timing budget of the first operating cycle "C" (or current regulation cycle).

Also, the frame time $\tau_F$ is $Z \times n \times \tau_P$ where n is the number of rows in the display, and Z is a function of number of iteration in a segment. For example, in FIG. 2, the $V_T$ generation starts from the first row of the segment and goes to the last row (the first iteration) and then the programming starts from the first row and goes to the last row (the second iteration). Accordingly, Z is set to 2. If the number of iteration increases, the frame time will become $Z \times n \times \tau_P$ in which Z is the number of iteration and may be greater than 2.

Figure 3:
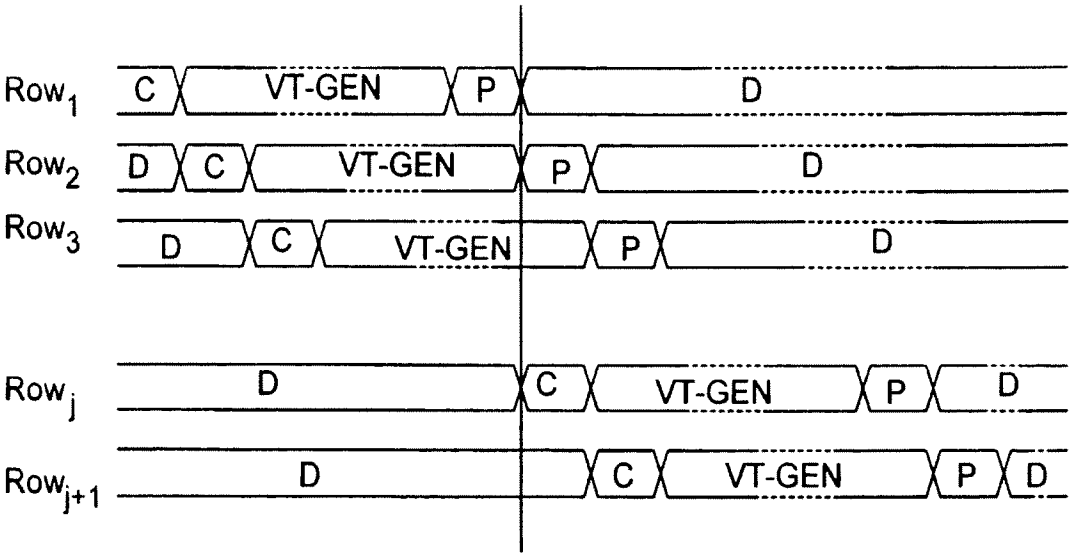
FIG. 3 illustrates an example of a parallel timing schedule for stable operation of a light emitting light display, in accordance with an embodiment of the present invention.

FIG. 3 illustrates an example of the parallel timing schedule for stable operation of a light emitting light display, in accordance with an embodiment of the present invention. In FIG. 3, "$Row_k$" (k=1, 2, 3, . . . , j, j+1) represents a kth row of a display array.

Figure 4:
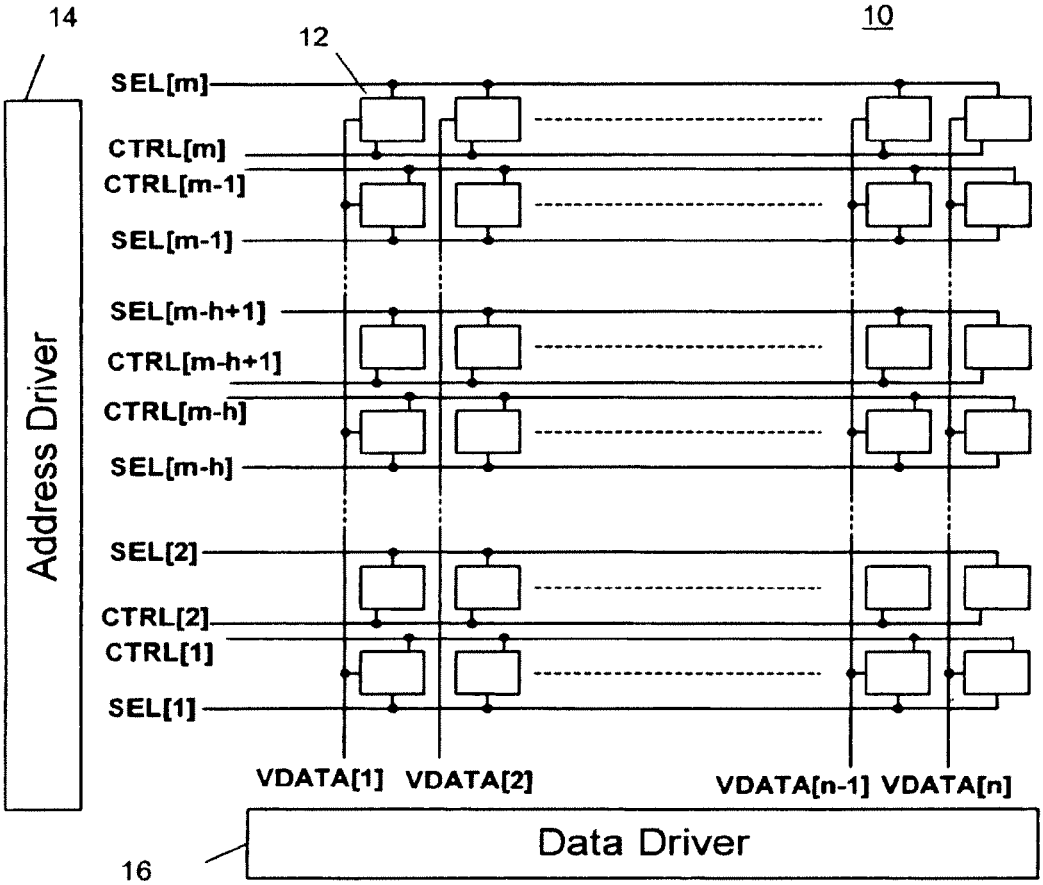
FIG. 4 illustrates an example of an AMOLED display array structure for the timing schedules of FIGS. 2 and 3.

Similar to FIG. 2, the timing schedule of FIG. 4 includes the compensation voltage generation cycle "C", the $V_T$-generation cycle "VT-GEN", the current-regulation cycle "P", and the driving cycle "D", for each row.

The timing schedule of FIG. 3 extends the timing budget of the $V_T$-generation cycle "VT-GEN", whereas $\tau_P$ is preserved as $\tau_P/n$, where $\tau_P$ is the timing budget of the first operating cycle "C", $\tau_F$ is a frame time, and n is the number of rows in the display array. In FIG. 3, $Row_1$ to $Row_j$ are in a segment in a plurality of rows of the display array.

According to the above addressing scheme, the current-regulation cycle "P" of each segment is preformed in parallel with the first operating cycles "C" of the next segment. Thus, the display array is designed to support the parallel operation, i.e., having capability of carrying out different cycles independently without affecting each other, e.g., compensation and programming, $V_T$-generation and current regulation.

FIG. 4 illustrates an example of an example of an AMOLED display array structure for the the timing schedules of FIGS. 2 and 3. In FIG. 4, SEL[a] (a=1, . . . , m) represents a select signal to select a row, CTRL[b] (b=1, . . . , m) represents a controlling signal to generate the threshold voltage of the drive TFT at each pixel in the row, and VDATA [c] (c=1, . . . , n) represents a data signal to provide a programming data. The AMOLED display 10 of FIG. 4 includes a plurality of pixel circuits 12 which are arranged in row and column, an address driver 14 for controlling SEL[a] and CTRL[b], and a data driver 16 for controlling VDATA[c]. The rows of the pixel circuits 12 (e.g., $Row_1$, . . . , $Row_{m-h}$ and $Row_{m-h+1}$, . . . , $Row_m$) are segmented as described above. To implement certain cycles in parallel, the AMOLED display 10 is designed to support the parallel operation.

Figure 5:
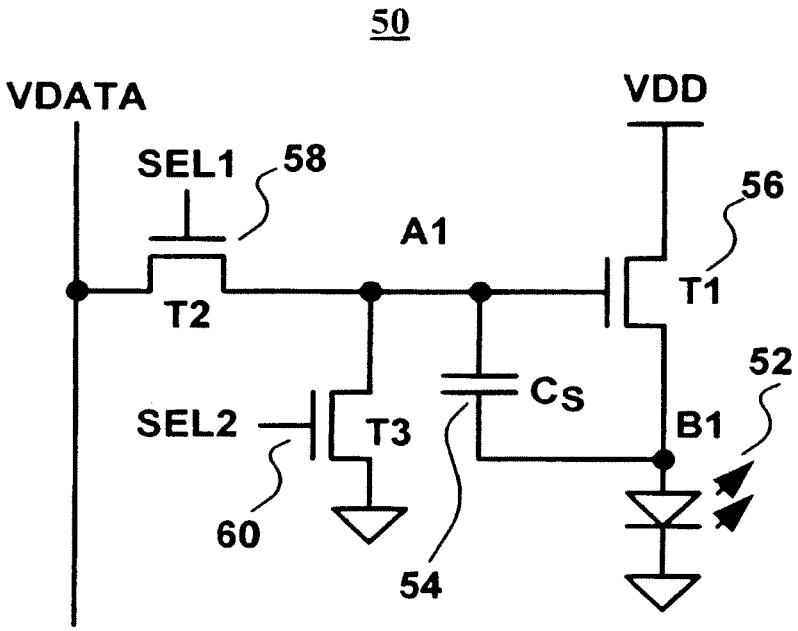
FIG. 5 illustrates an example of a voltage programmed pixel circuit to which the segmented timing schedule and the parallel timing schedule are applicable.

FIG. 5 illustrates an example of a pixel circuit to the segmented timing schedule and parallel timing schedule are applicable. The pixel circuit 50 of FIG. 5 includes an OLED 52, a storage capacitor 54, a drive TFT 56, and switch TFTs 58 and 60. A select line SEL1 is connected to the gate terminal of the switch TFT 58. A select line SEL2 is connected to the gate terminal of the switch TFT 60. The first terminal of the switch TFT 58 is connected to a data line VDATA, and the second terminal of the switch TFT 58 is connected to the gate of the drive TFT 56 at node A1. The first terminal of the switch TFT 60 is connected to node A1, and the second terminal of the switch TFT 60 is connected to a ground line. The first terminal of the drive TFT 56 is connected to a controllable voltage supply VDD, and the second terminal of the drive TFT 56 is connected to the anode electrode of the OLED 52 at node B1. The first terminal of the storage capacitor 54 is connected to node A1, and the second terminal of the storage capacitor 54 is connected to node B1. The pixel circuit 50 can be used with the segmented timing schedule, the parallel timing schedule, and a combination thereof.

$V_T$-generation occurs through the transistors 56 and 60, while current regulation is performed by the transistor 58 through the VDATA line. Thus, this pixel is capable of implementing the parallel operation.

Figure 6:
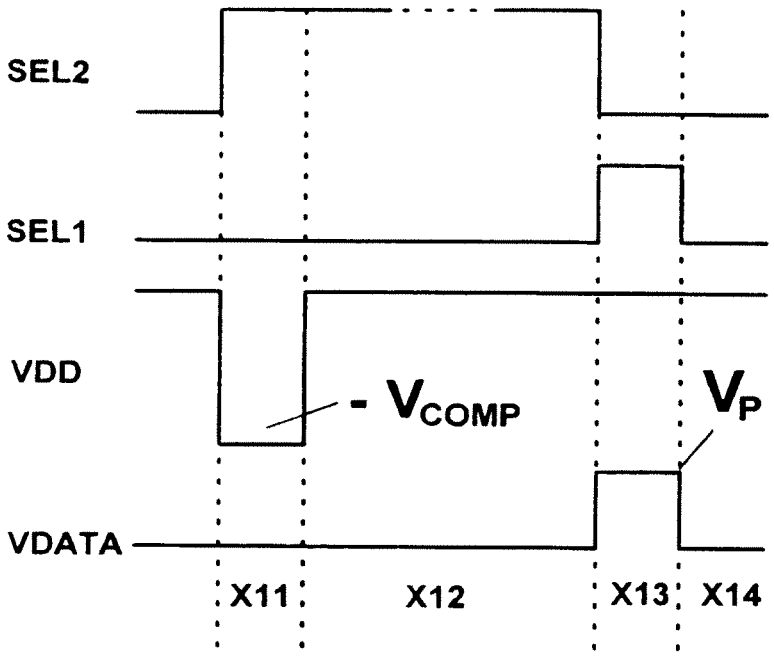
FIG. 6 illustrates an example of a timing schedule applied to the pixel circuit of FIG. 5.
Figure 7:
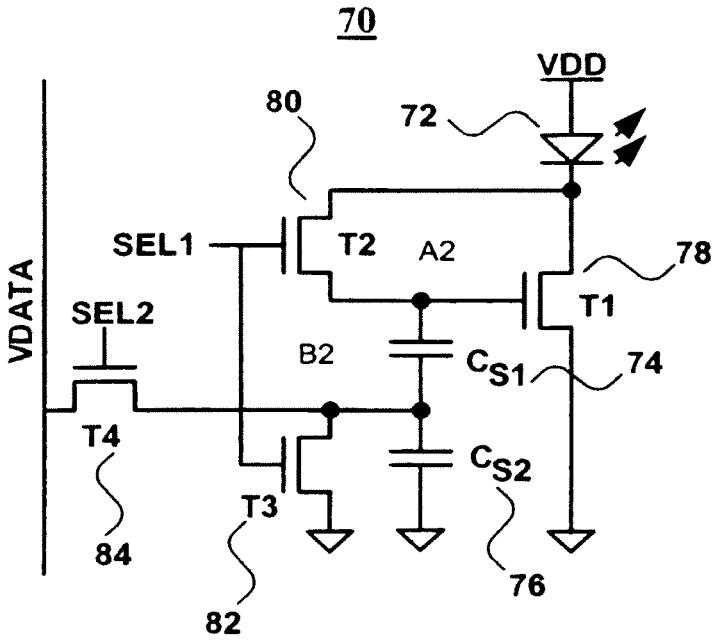
FIG. 7 illustrates another example of a voltage programmed pixel circuit to which the segmented timing schedule and the parallel timing schedule are applicable.

FIG. 6 illustrates an example of a timing schedule applied to the pixel circuit 50. In FIG. 7, "X11", "X12", "X13", and "X14" represent operating cycles. X11 corresponds to "C" of FIGS. 2 and 3, X12 corresponds to "VT-GEN" of FIGS. 2 and 3, X13 corresponds to "P" of FIGS. 2 and 3, and X14 corresponds to "D" of FIGS. 2 and 3.

Referring to FIGS. 5 and 6, the storage capacitor 54 is charged to a negative voltage (−Vcomp) during the first operating cycle X11, while the gate voltage of the drive TFT 56 is zero. During the second operating cycle X12, node B1 is charged up to $-V_T$ where $V_T$ is the threshold of the drive TFT 56. This cycle X12 can be done without affecting the data line VDATA since it is preformed through the switch transistor 60, not the switch transistor 58, so that the other operating cycle can be executed for the other rows. During the third operating cycle X13, node A1 is charged to a programming voltage $V_P$, resulting in $V_{GS}=V_P+V_T$ where $V_{GS}$ represents a gate-source voltage of the drive TFT 56.

FIG. 7 illustrates another example of a pixel circuit to the segmented timing schedule and the parallel timing schedules are applicable. The pixel circuit 70 of FIG. 7 includes an OLED 72, storage capacitors 74 and 76, a drive TFT 78, and switch TFTs 80, 82 and 84. A first select line SEL1 is connected to the gate terminal of the switch TFTs 80 and 82. A second select line SEL2 is connected to the gate terminal of the switch TFT 84. The first terminal of the switch TFT 80 is connected to the cathode of the OLED 72, and the second terminal of the switch TFT 80 is connected to the gate terminal of the drive TFT 78 at node A2. The first terminal of the switch TFT 82 is connected to node B2, and the second terminal of the switch TFT 82 is connected to a ground line. The first terminal of the switch TFT 84 is connected to a data line VDATA, and the second terminal of the switch TFT 84 is connected to node B2. The first terminal of the storage capacitor 74 is connected to node A2, and the second terminal of the storage capacitor 74 is connected to node B2. The first terminal of the storage capacitor 76 is connected to node B2, and the second terminal of the storage capacitor 76 is connected to a ground line. The first terminal of the drive TFT 78 is connected to the cathode electrode of the OLED 72, and the second terminal of the drive TFT 78 is coupled to a ground line. The anode electrode of the OLED 72 is coupled to a controllable voltage supply VDD. The pixel circuit 70 has the capability of adopting the segmented timing schedule, the parallel timing schedule, and a combination thereof.

$V_T$-generation occurs through the transistors 78, 80 and 82, while current regulation is performed by the transistor 84 through the VDATA line. Thus, this pixel is capable of implementing the parallel operation.

Figure 8:
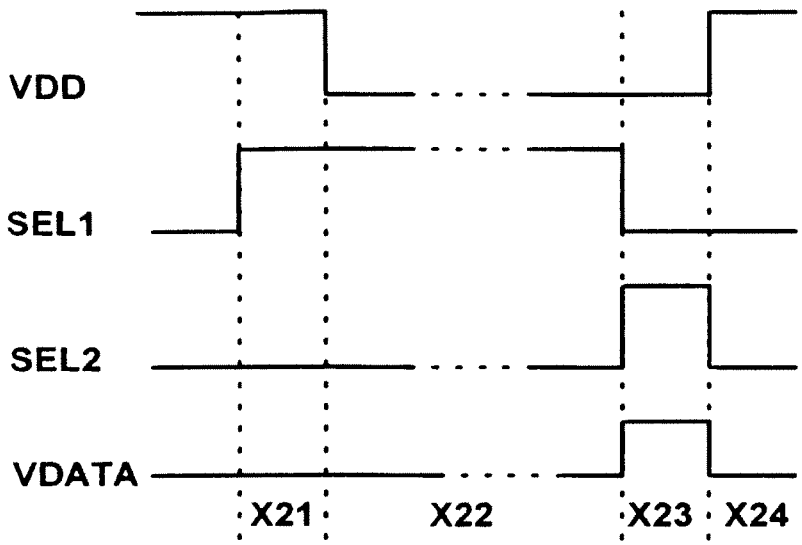
FIG. 8 illustrates an example of a timing schedule applied to the pixel circuit of FIG. 7.

FIG. 8 illustrates an example of a timing schedule applied to the pixel circuit 70. In FIG. 8, "X21", "X22", "X23", and "X24" represent operating cycles. X21 corresponds to "C" of FIGS. 2 and 3, X22 corresponds to "VT-GEN" of FIGS. 2 and 3, X23 corresponds to "P" of FIGS. 2 and 3, and X24 corresponds to "D" of FIGS. 2 and 3.

Referring to FIGS. 7 and 8, the pixel circuit 70 employs bootstrapping effect to add a programming voltage to the stored $V_T$ where $V_T$ is the threshold voltage of the drive TFT 78. During the first operating cycle x21, node A2 is charged to a compensating voltage, VDD-$V_{OLED}$ where $V_{OLED}$ is a voltage of the OLED 72, and node B2 is discharged to ground. During the second operating cycle X22, voltage at node A2 is changed to the $V_T$ of the drive TFT 78. The current regulation occurs in the third operating cycle X23 during which node B2 is charged to a programming voltage $V_P$ so that node A2 changes to $V_P+V_T$.

The segmented timing schedule and the parallel timing schedule described above provide enough time for the pixel circuit to generate an accurate threshold voltage of the drive TFT. As a result, it generates a stable current despite the pixel aging, process variation, or a combination thereof. The operating cycles are shared in a segment such that the programming cycle of a row in the segment is overlapped with the programming cycle of another row in the segment. Thus, they can maintain high display speed, regardless of the size of the display.

A shared signaling addressing scheme is described in detail. According to the shared signaling addressing scheme, the rows in the display array are divided into few segments. The aging factor (e.g., threshold voltage of the drive TFT, OLED voltage) of the pixel circuit is stored in the pixel. The stored aging factor is used for a plurality of frames. One or more signals required to generate the aging factor are shared in the segment.

For example, the threshold voltage $V_T$ of the drive TFT is generated for each segment at the same time. After that, the segment is put on the normal operation. All extra signals besides the data line and select line required to generate the threshold voltage (e.g., VSS of FIG. 10) are shared between the rows in each segment. Considering that the leakage current of the TFT is small, using a reasonable storage capacitor to store the $V_T$ results in less frequent compensation cycle. As a result, the power consumption reduces dramatically.

Since the $V_T$-generation cycle is carried out for each segment, the time assigned to the $V_T$-generation cycle is extended by the number of rows in a segment leading to more precise compensation. Since the leakage current of a-Si: TFTs is small (e.g., the order of $10^{-14}$), the generated $V_T$ can be stored in a capacitor and be used for several other frames. As a result, the operating cycles during the next post-compensation frames are reduced to the programming and driving cycles. Consequently, the power consumption associated with the external driver and with charging/discharging the parasitic capacitances is divided between the same few frames.

Figure 9:
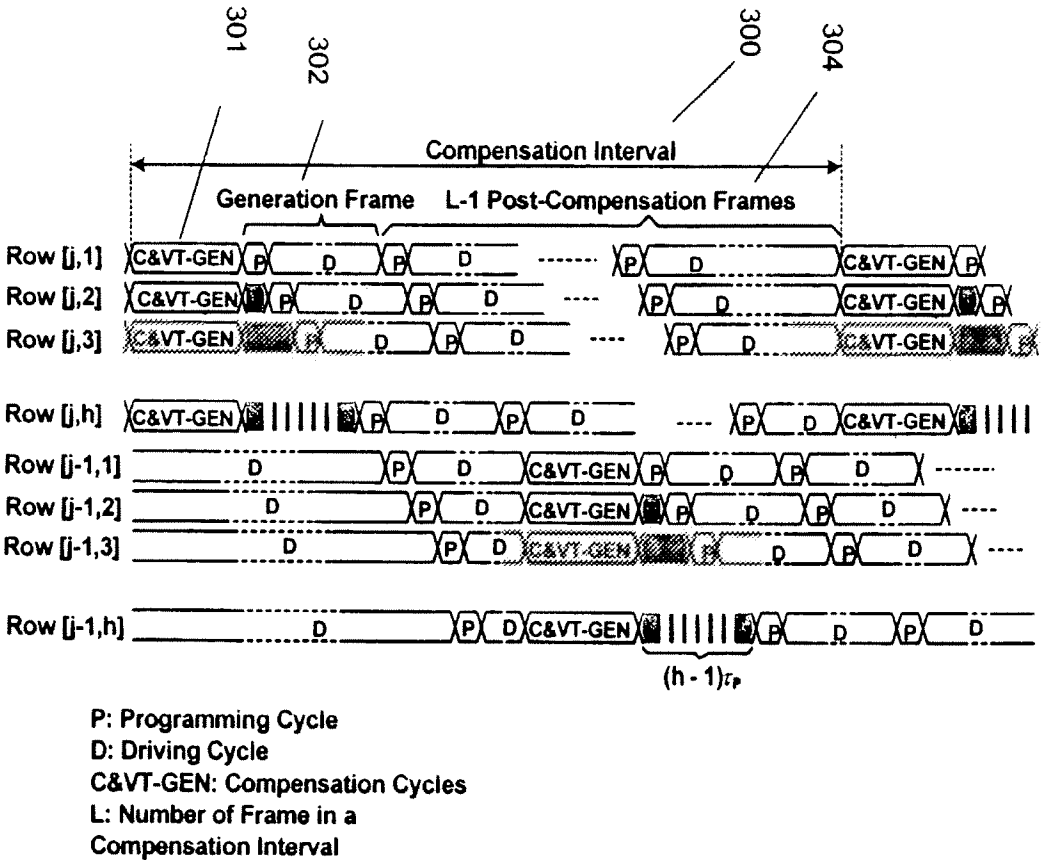
FIG. 9 illustrates an example of a shared signaling addressing scheme for a light emitting display, in accordance with an embodiment of the present invention.

FIG. 9 illustrates an example of the shared signaling addressing scheme for a light emitting light display, in accordance with an embodiment of the present invention. The shared signaling addressing scheme reduces the interface and driver complexity.

A display array to which the shared signaling addressing scheme is applied is divided into few segments, similar to those for FIGS. 2 and 3. In FIG. 9, "Row [j, k]" (k=1, 2, 3, . . . , h) represents the $k^{th}$ row in the $j^{th}$ segment, "h" is the number of row in each segment, and "L" is the number of frames that use the same generated $V_T$. In FIG. 9, "Row [j, k]" (k=1, 2, 3, . . . , h) is in a segment, and "Row [j−1, k]" (k=1, 2, 3, . . . , h) is in another segment.

The timing schedule of FIG. 9 includes compensation cycles "C & VT-GEN" (e.g. 301 of FIG. 9), a programming cycle "P", and a driving cycle "D". A compensation interval 300 includes a generation frame cycle 302 in which the threshold voltage of the drive TFT is generated and stored inside the pixel, compensation cycles "C & VT-GEN" (e.g. 301 of FIG. 9), besides the normal operation of the display, and L-1 post compensation frames cycles 304 which are the normal operation frame. The generation frame cycle 302 includes one programming cycle "P" and one driving cycle "D". The L-1 post compensation frames cycle 304 includes a set of the programming cycle "P" and the driving cycle "D", in series.

As shown in FIG. 9, the driving cycle of each row starts with a delay of $\tau_P$ from the previous row where $\tau_P$ is the timing budget assigned to the programming cycle "P". The timing of the driving cycle "D" at the last frame is reduced for each rows by $i*\tau_P$ where "i" is the number of rows before that row in the segment (e.g., (h-1) for Row [j, h]).

Figure 10:
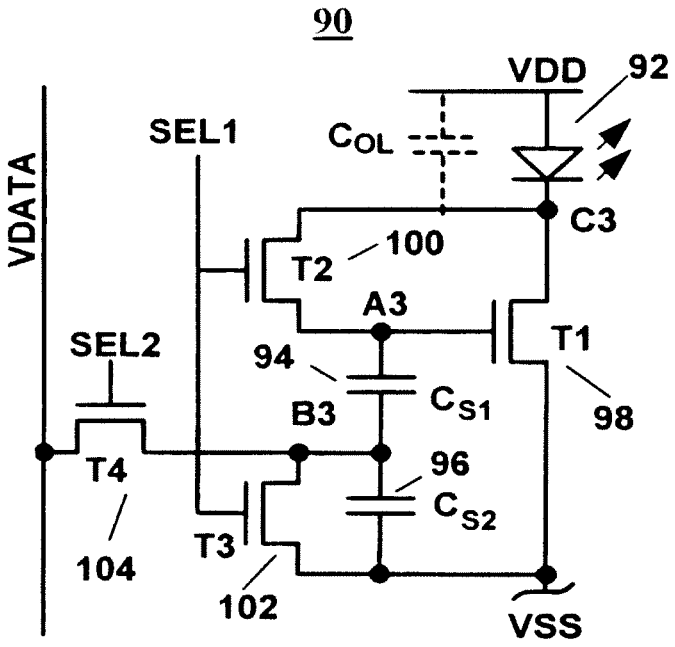
FIG. 10 illustrates an example of a pixel circuit to which the shared signaling addressing scheme is applicable.

Since $\tau_P$ (e.g., the order of 10 μs) is much smaller than the frame time (e.g., the order of 16 ms), the latency effect is negligible. However, to minimize this effect, the programming direction may be changed each time, so that the average brightness lost due to latency becomes equal for all the rows or takes into consideration this effect in the programming voltage of the frames before and after the compensation cycles. For example, the sequence of programming the row may be changed after each $V_T$-generation cycle (i.e., programming top-to-bottom and bottom-to-top iteratively), FIG. 10 illustrates an example of a pixel circuit to which the shared signaling addressing scheme is applicable. The pixel circuit 90 of FIG. 10 includes an OLED 92, storage capacitors 94 and 96, a drive TFT 98, and switch TFTs 100, 102 and 104. The pixel circuit 90 is similar to the pixel circuit 70 of FIG. 7. The drive TFT 98, the switch TFT 100, and the first storage capacitor 94 are connected at node A3. The switch TFTs 102 and 104, and the first and second storage capacitors 94 and 96 are connected at node B3. The OLED 92, the drive TFT 98 and the switch TFT 100 are connected at node C3. The switch TFT 102, the second storage capacitor 96, and the drive TFT 98 are connected to a controllable voltage supply VSS.

Figure 11:
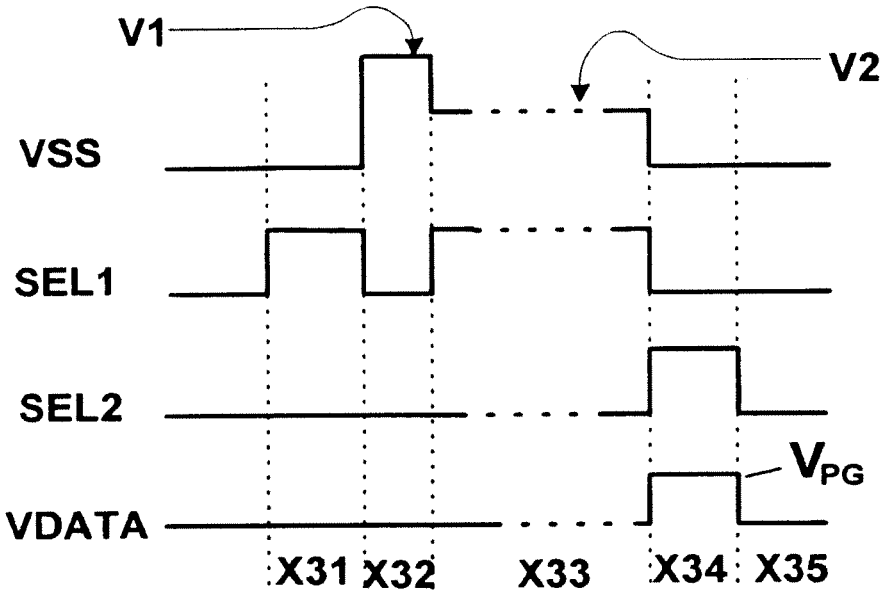
FIG. 11 illustrates an example of a timing schedule applied to the pixel circuit of FIG. 10.

FIG. 11 illustrates an example of a timing schedule applied to the pixel circuit 90. In FIG. 11, "X31", "X32", "X33", "X34", and "X35" represent operating cycles. X31, X32 and X33 correspond to the compensation cycles (e.g. 301 of FIG. 9), X34 corresponds to "P" of FIG. 9, and X35 correspond to "D" of FIG. 9.

Referring to FIGS. 10 and 11, the pixel circuit 90 employs a bootstrapping effect to add the programming voltage to the generated $V_T$ where $V_T$ is the threshold voltage of the drive TFT 98. The compensation cycles (e.g. 301 of FIG. 9) include the first three cycles X31, X32, and X33. During the first operating cycle X31, node A3 is charged to a compensation voltage, VDD-$V_{OLED}$. The timing of the first operating cycle X31 is small to control the effect of unwanted emission. During the second operating cycle X32, VSS goes to a high positive voltage V1 (for example, V1=20 V), and thus node A3 is bootstrapped to a high voltage, and also node C3 goes to V1, resulting in turning off the OLED 92. During the third operating cycle X33, the voltage at node A3 is discharged through the switch TFT 100 and the drive TFT 98 and settles to V2+$V_T$ where $V_T$ is the threshold voltage of the drive TFT 98, and V2 is, for example, 16 V. VSS goes to zero before the current-regulation cycle, and node A3 goes to $V_T$. A programming voltage $V_{PG}$ is added to the generated $V_T$ by bootstrapping during the fourth operating cycle X34. The current regulation occurs in the fourth operating cycle X34 during which node B3 is charged to the programming voltage $V_{PG}$ (for example, $V_{PG}$=6V). Thus the voltage at node A3 changes to $V_{PG}+V_T$ resulting in an overdrive voltage independent of $V_T$. The current of the pixel circuit during the fifth cycle X35 (driving cycle) becomes independent of $V_T$ shift. Here, the first storage capacitor 94 is used to store the $V_T$ during the $V_T$-generation interval.

Figure 12:
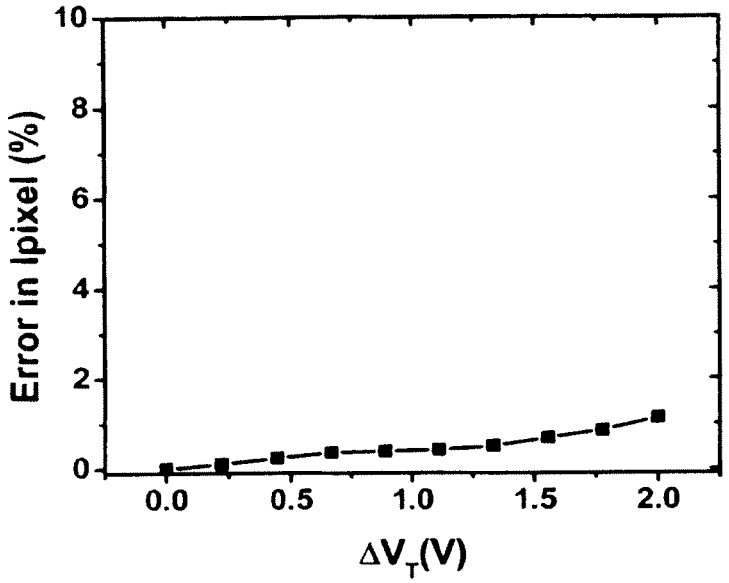
FIG. 12 illustrates the pixel current stability of the pixel circuit of FIG. 10.

FIG. 12 illustrates the pixel current stability of the pixel circuit 90 of FIG. 10. In FIG. 12, "$\Delta V_T$" represents the shift in the threshold voltage of the drive TFT (e.g., 98 of FIG. 10), and "Error in 1 pixel (%)" represents the change in the pixel current causing by $\Delta V_T$ As shown in FIG. 12, the pixel circuit 90 of FIG. 10 provides a highly stable current even after a 2-V shift in the $V_T$ of the drive TFT.

Figure 13:
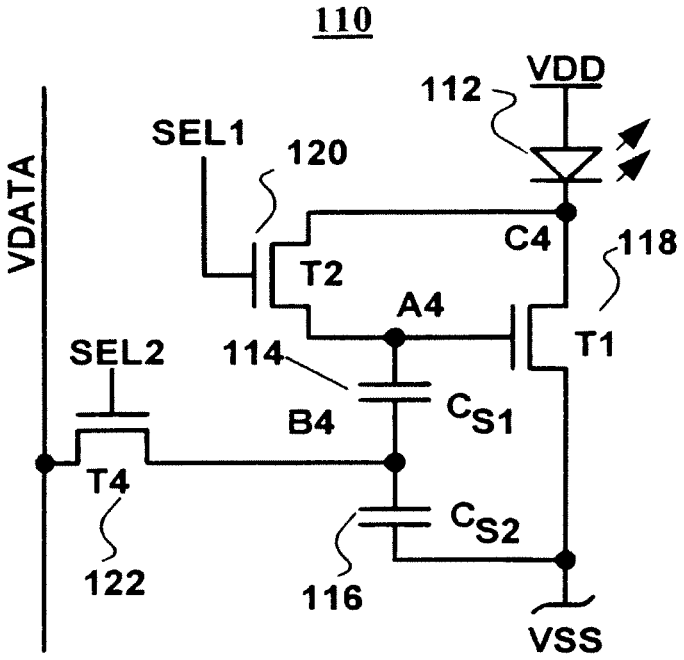
FIG. 13 illustrates another example of a pixel circuit to which the shared signaling addressing scheme is applicable.

FIG. 13 illustrates another example of a pixel circuit to which the shared signaling addressing scheme is applicable. The pixel circuit 110 of FIG. 13 is similar to the pixel circuit 90 of FIG. 10, and, however, includes two switch TFTs. The pixel circuit 110 includes an OLED 112, storage capacitors 114 and 116, a drive TFT 118, and switch TFTs 120 and 122. The drive TFT 118, the switch TFT 120, and the first storage capacitor 114 are connected at node A4. The switch TFTs 122 and the first and second storage capacitors 114 and 116 are connected at node B4. The cathode of the OLED 112, the drive TFT 118 and the switch TFT 120 are connected to node C4. The second storage capacitor 116 and the drive TFT 118 are connected to a controllable voltage supply VSS.

Figure 14:
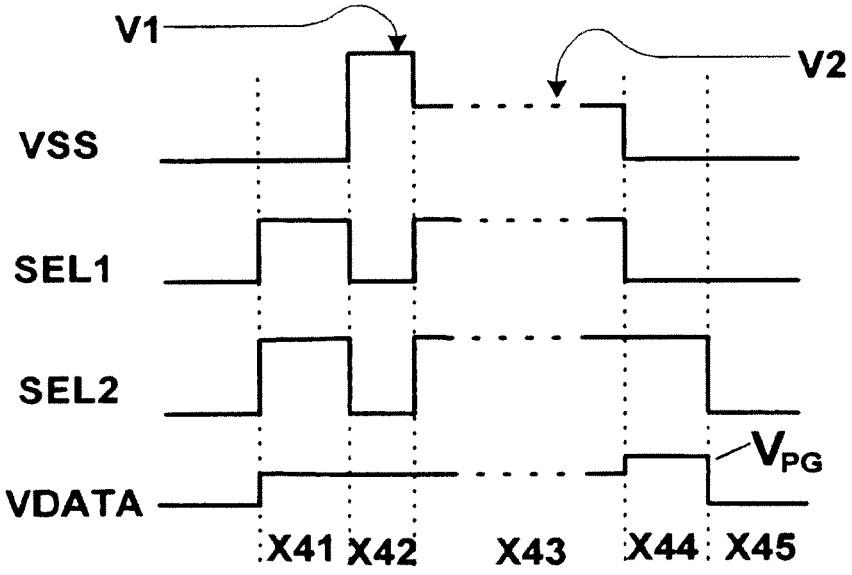
FIG. 14 illustrates an example of a timing schedule applied to the pixel circuit of FIG. 13.
Figure 15:
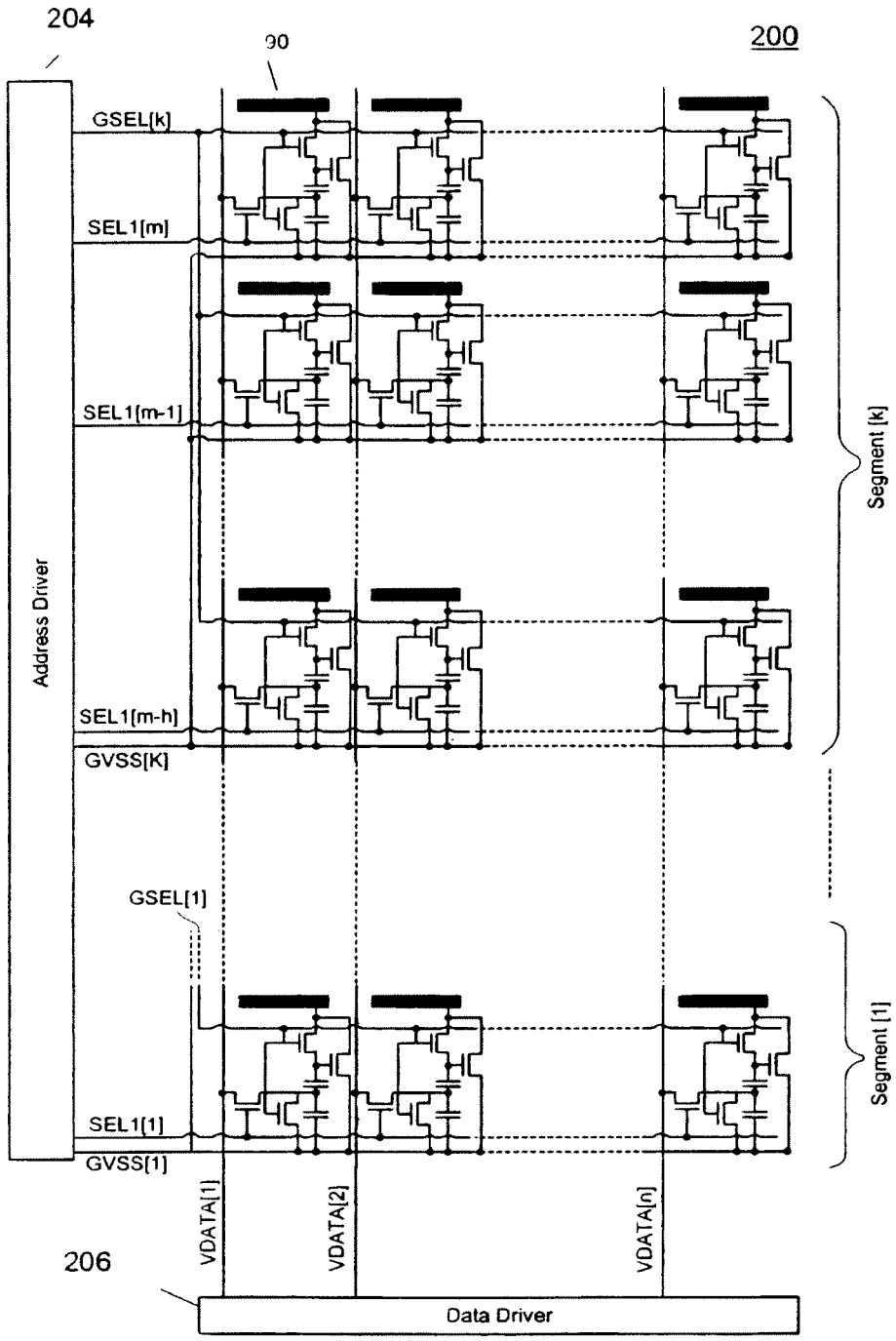
FIG. 15 illustrates an example of an AMOLED display array structure for the pixel circuit of FIG. 10.

FIG. 14 illustrates an example of a timing schedule applied to the pixel circuit 110. In FIG. 15, "X41", "X42", "X43", "X44", and "X44" represent operating cycles. X41, X42, and X43 correspond to compensation cycles (e.g. 301 of FIG. 9), X44 correspond to "P" of FIG. 9, and X45 correspond to "D" of FIG. 9.

Referring to FIGS. 13 and 14, the pixel circuit 110 employs a bootstrapping effect to add the programming voltage to the generated $V_T$. The compensation cycles (e.g. 301 of FIG. 9) include the first three cycles X41, X42, and X43. During the first operating cycle X41, node A4 is charged to a compensation voltage, VDD-$V_{OLED}$. The timing of the first operating cycle X41 is small to control the effect of unwanted emission. During the second operating cycle X42, VSS goes to a high positive voltage V1 (for example, V1=20 V), and so node A4 is bootstrapped to a high voltage, and also node C4 goes to V1, resulting in turning off the OLED 112. During the third operating cycle X43, the voltage at node A4 is discharged through the switch TFT 120 and the drive TFT 118 and settles to V2+$V_T$ where $V_T$ is the threshold voltage of the drive TFT 118 and V2 is, for example, 16 V. VSS goes to zero before the current-regulation cycle, and thus node A4 goes to $V_T$. A programming voltage $V_{PG}$ is added to the generated $V_T$ by bootstrapping during the fourth operating cycle X44. The current regulation occurs in the fourth operating cycle X44 during which node B4 is charged to the programming voltage $V_{PG}$ (for example, $V_{PG}$=6 V). Thus the voltage at node A4 changes to $V_{PG}$+$V_T$ resulting in an overdrive voltage independent of $V_T$. The current of the pixel circuit during the fifth cycle X45 (driving cycle) becomes independent of $V_T$ shift. Here, the first storage capacitor 114 is used to store the $V_T$ during the $V_T$-generation interval.

FIG. 15 illustrates an example of an AMOLED display structure for the pixel circuit of FIG. 10. In FIG. 15, GSEL[a] (a=1, . . . , k) corresponds to SEL2 of FIG. 10, SEL1[b] (b=1, . . . , m) corresponds to SEL1 of FIG. 10, GVSS[c] (c=1, . . . , k) corresponds to VSS of FIG. 10, VDATA[d] (d=1, . . . , n) corresponds to VDATA of FIG. 10. The AMOLED display 200 of FIG. 15 includes a plurality of pixel circuits 90 which are arranged in row and column, an address driver 204 for controlling GSEL[a], SEL1[b] and GVSS[c], and a data driver 206 for controlling VDATA[s]. The rows of the pixel circuits 90 are segmented as described above. In FIG. 15, segment [l] and segment [k] are shown as examples.

Referring to FIGS. 10 and 15, SEL2 and VSS signals of the rows in one segment are connected together and form GSEL and GVSS signals.

Figure 16:
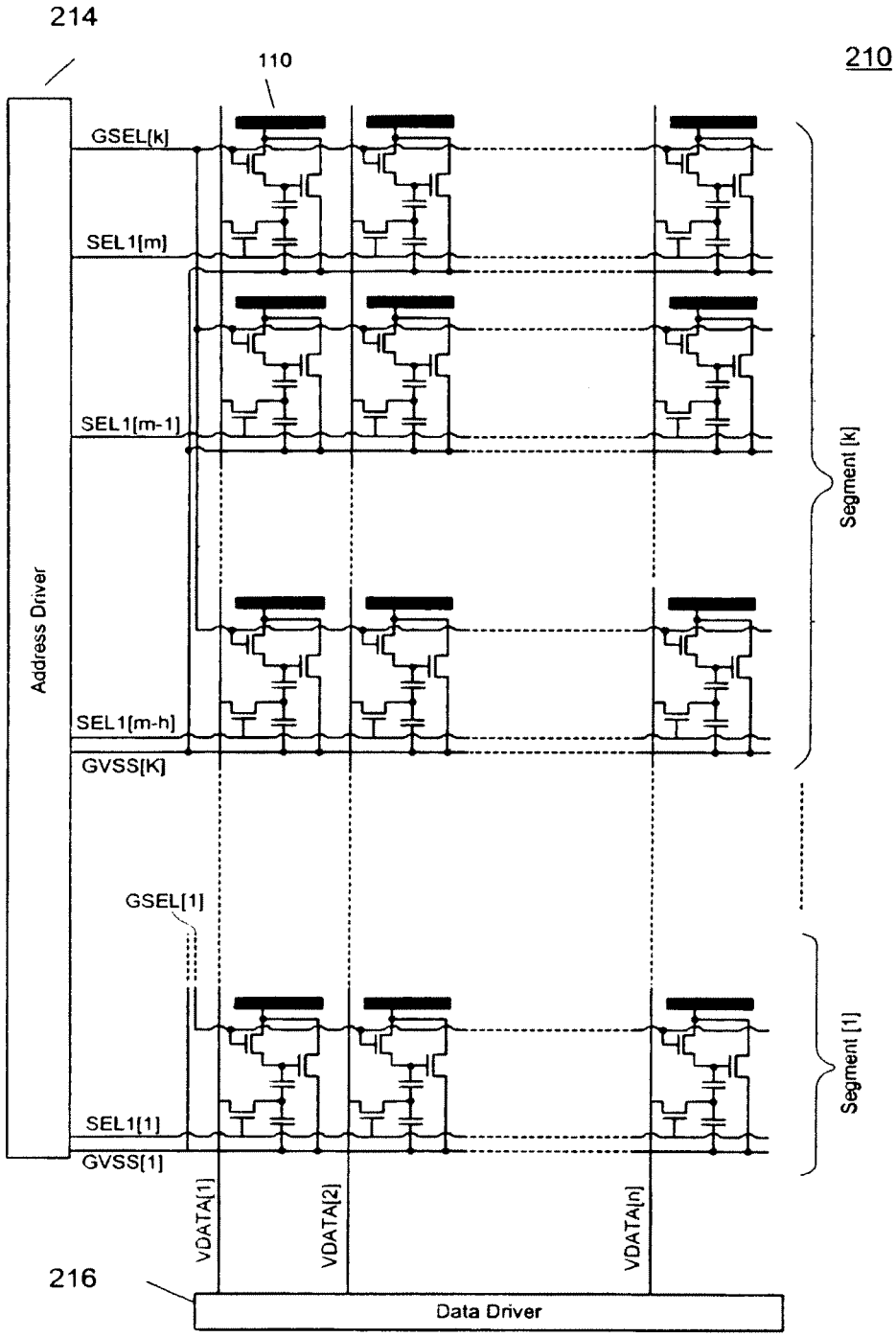
FIG. 16 illustrates an example of an AMOLED display array structure for the pixel circuit of FIG. 13.
Figure 17:
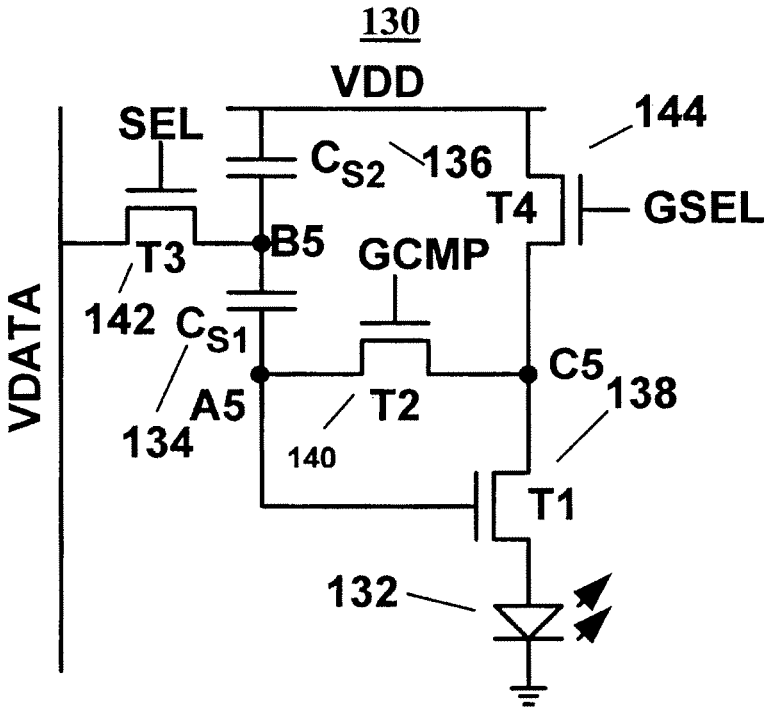
FIG. 17 illustrates a further example of a pixel circuit to which the shared signaling addressing scheme is applicable.

FIG. 16 illustrates an example of an AMOLED display structure for the pixel circuit of FIG. 14. In FIG. 17, GSEL[a] (a=1, . . . , k) corresponds to SEL2 of FIG. 14, SEL1[b] (b=1, . . . , m) corresponds to SEL1 of FIG. 14, GVSS[c] (c=1, . . . , k) corresponds to VSS of FIG. 14, VDATA[d] (d=1, . . . , n) corresponds to VDATA of FIG. 14. The AMOLED display 210 of FIG. 16 includes a plurality of pixel circuits 110 which are arranged in row and column, an address driver 214 for controlling GSEL[a], SEL1[b] and GVSS[c], and a data driver 216 for controlling VDATA[s]. The rows of the pixel circuits 110 are segmented as described above. In FIG. 15, segment [l] and segment [k] are shown as examples.

Referring to FIGS. 14 and 16, SEL2 and VSS signals of the rows in one segment are connected together and form GSEL and GVSS signals.

Referring to FIGS. 15 and 16, the display arrays can diminish its area by sharing VSS and GSEL signals between physically adjacent rows. Moreover, GVSS and GSEL in the same segment are merged together and form the segment GVSS and GSEL lines. Thus, the controlling signals are reduced. Further, the number of blocks driving the signals is also reduced resulting in lower power consumption and lower implementation cost.

FIG. 17 illustrates a further example of a pixel circuit to which the shared signaling addressing scheme is applicable. The pixel circuit of FIG. 17 includes an OLED 132, storage capacitors 134 and 136, a drive TFT 138, and switch TFTs 140, 142 and 144. A first select line SEL is connected to the gate terminal of the switch TFT 142. A second select line GSEL is connected to the gate terminal of the switch TFT 144. A GCOMP signal line is connected to the gate terminal of the switch TFT 140. The first terminal of the switch TFT 140 is connected to node A5, and the second terminal of the switch TFT 140 is connected to node C5. The first terminal of the drive TFT 138 is connected to node C5 and the second terminal of the drive TFT 138 is connected to the anode of the OLED 132. The first terminal of the switch TFT 142 is connected to a data line VDATA, and the second terminal of the switch TFT 142 is connected to node B5. The first terminal of the switch TFT 144 is connected to a voltage supply VDD, and the second terminal of the switch TFT 144 is connected to node C5. The first terminal of the first storage capacitor 134 is connected to node A5, and the second terminal of the first storage capacitor 134 is connected to node B5. The first terminal of the second storage capacitor 136 is connected to node B5, and the second terminal of the second storage capacitor 136 is connected to VDD.

Figure 18:
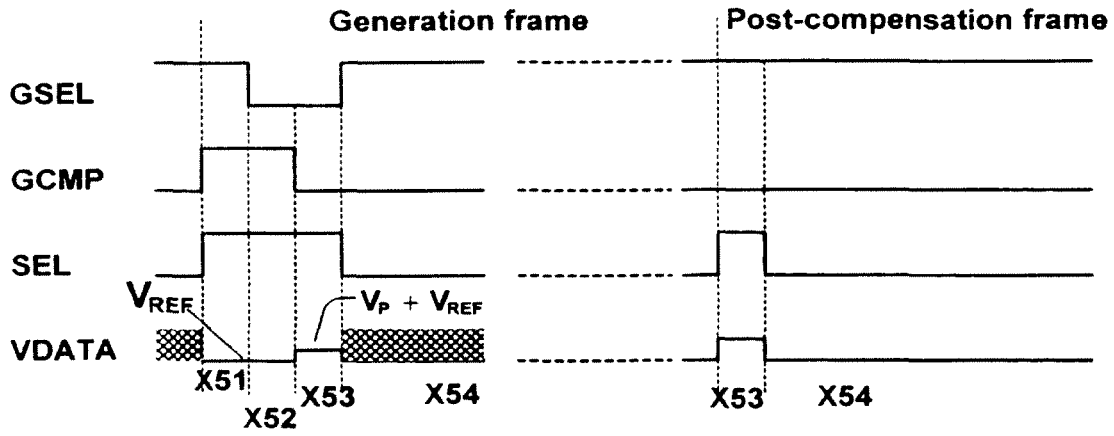
FIG. 18 illustrates an example of a timing schedule applied to the pixel circuit of FIG. 17.

FIG. 18 illustrates an example of a timing schedule applied to the pixel circuit 130. In FIG. 18, operating cycles X51, X52, X53, and X54 form a generating frame cycle (e.g., 302 of FIG. 9), the second operating cycles X53 and X54 form a post-compensation frame cycle (e.g., 304 of FIG. 9). X53 and X54 are the normal operation cycles whereas the rest are the compensation cycles.

Referring to FIGS. 17 and 18, the pixel circuit 130 employs bootstrapping effect to add a programming voltage to the generated $V_T$ where $V_T$ is the threshold voltage of the drive TFT 138. The compensation cycles (e.g. 301 of FIG. 9) include the first two cycles X51 and X52. During the first operating cycle X51, node A5 is charged to a compensation voltage, and node B5 is charged to $V_{REF}$ through the switch TFT 142 and VDATA. The timing of the first operating cycle X51 is small to control the effect of unwanted emission. During the second operating cycle X52, GSEL goes to zero and thus it turns off the switch TFT 144. The voltage at node A5 is discharged through the switch TFT 140 and the drive TFT 138 and settles to $V_{OLED}$+$V_T$ where $V_{OLED}$ is the voltage of the OLED 132, and $V_T$ is the threshold voltage of the drive TFT 138. During the programming cycle, i.e., the third operating cycle X53, node B5 is charged to $V_P$+$V_{REF}$ where $V_P$ is a programming voltage. Thus the gate voltage of the drive TFT 138 becomes $V_{OLED}$+$V_T$+$V_P$. Here, the first storage capacitor 134 is used to store the $V_T$+$V_{OLED}$ during the compensation interval.

Figure 19:
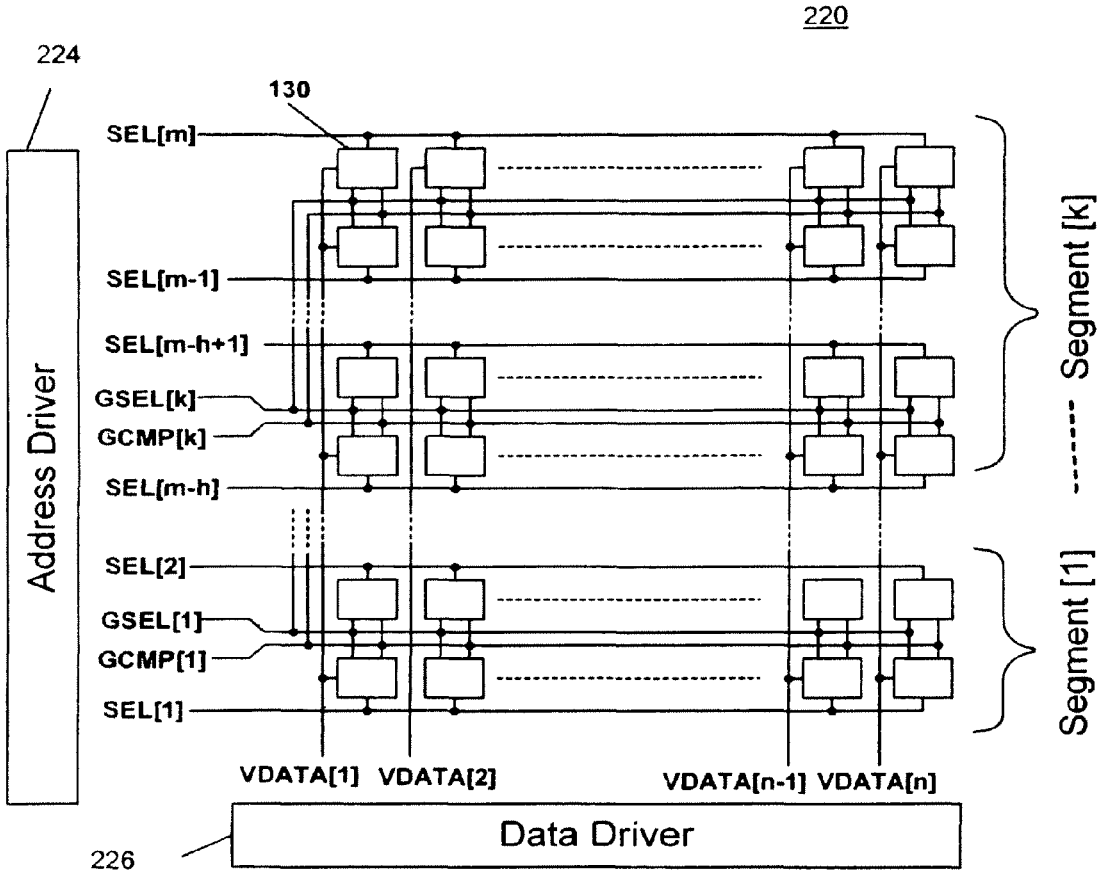
FIG. 19 illustrates an example of an AMOLED display array structure for the pixel circuit of FIG. 17.

FIG. 19 illustrates an example of an AMOLED display array structure for the pixel circuit 130 of FIG. 17. In FIG. 19, GSEL[a] (a=1, . . . k) corresponds to GSEL of FIG. 17, SEL[b] (b=1, . . . , m) corresponds to SEL1 of FIG. 17, GCMP[c] (c=1, . . . , k) corresponds to GCOMP of FIG. 17, VDATA[d] (d=1, . . . , n) corresponds to VDATA of FIG. 17. The AMOLED display 220 of FIG. 19 includes a plurality of pixel circuits 130 which are arranged in row and column, an address driver 224 for controlling SEL[a], GSEL[b], and GCOMP[c], and a data driver 226 for controlling VDATA[c]. The rows of the pixel circuits 130 are segmented (e.g., segment [l] and segment [k]) as described above.

As shown in FIGS. 17 and 19, GSEL and GCOMP signals of the rows in one segment are connected together and form GSEL and GCOMP lines. GSEL and GCOMP signals are shared in the segment. Moreover, GVSS and GSEL in the same segment are merged together and form the segment GVSS and GSEL lines. Thus, the controlling signals are reduced. Further, the number of blocks driving the signals is also reduced resulting in lower power consumption and lower implementation cost.

Figure 20:
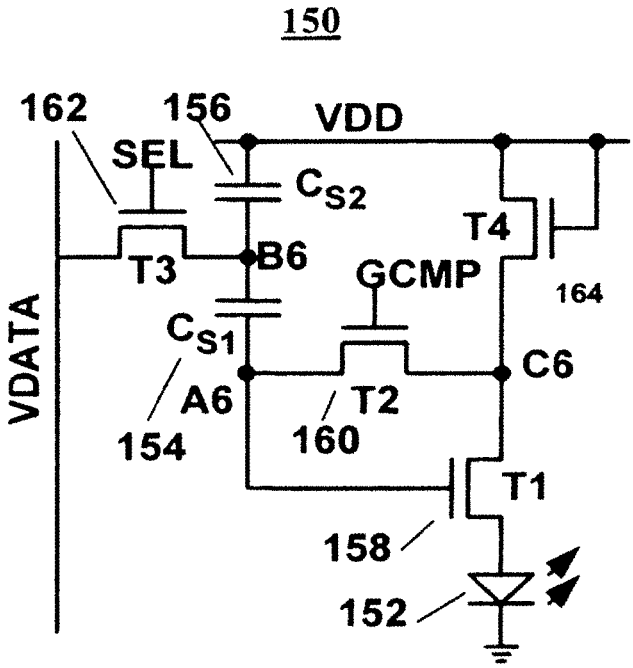
FIG. 20 illustrates a further example of a pixel circuit to which the shared signaling addressing scheme is applicable.

FIG. 20 illustrates a further example of a pixel circuit to which the shared addressing scheme is applicable. The pixel circuit 150 of FIG. 20 is similar to the pixel circuit 130 of FIG. 17. The pixel circuit 150 includes an OLED 152, storage capacitors 154 and 156, a drive TFT 158, and switch TFTs 160, 162, and 164. The gate terminal of the switch 164 is connected to a controllable voltage supply VDD, rather than GSEL. The drive TFT 158, the switch TFT 162 and the first storage capacitor 154 are connected at node A6. The switch TFT 162 and the first and second storage capacitors 154 and 156 are connected at node B6. The drive TFT 158 and the switch TFTs 160 and 164 are connected to node C6.

Figure 21:
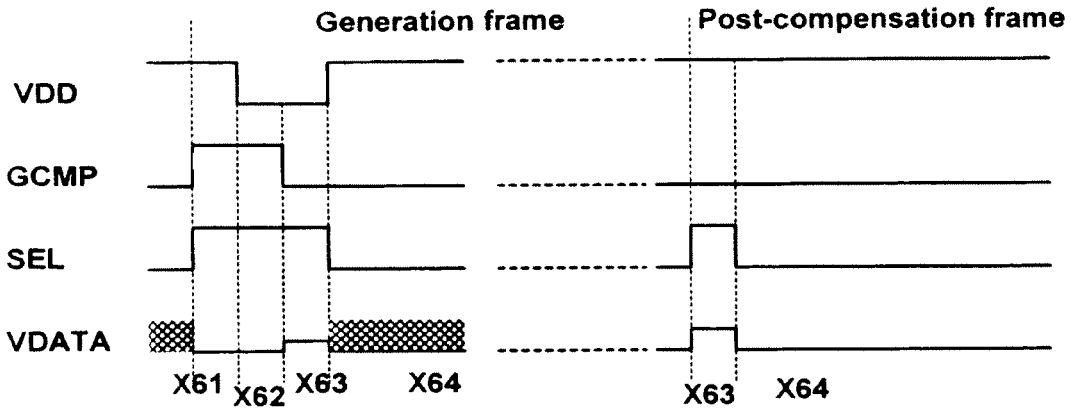
FIG. 21 illustrates an example of a timing schedule applied to the pixel circuit of FIG. 20.

FIG. 21 illustrates an example of a timing schedule applied to the pixel circuit 150. In FIG. 21, operating cycles X61, X62, X63, and X64 form a generating frame cycle (e.g., 302 of FIG. 9), the second operating cycles X63 and X64 form a post-compensation frame cycle (e.g., 304 of FIG. 9).

Referring to FIGS. 20 and 21, the pixel circuit 150 employs bootstrapping effect to add a programming voltage to the generated $V_T$ where $V_T$ is the threshold voltage of the drive TFT 158. The compensation cycles (e.g. 301 of FIG. 9) include the first two cycles X61 and X62. During the first operating cycle X61, node A6 is charged to a compensation voltage, and node B6 is charged to V through the switch TFT 162 and VDATA. The timing of the first operating cycle x61 is small to control the effect of unwanted emission. During the second operating cycle x62, VDD goes to zero and thus it turns off the switch TFT 164. The voltage at node A6 is discharged through the switch TFT 160 and the drive TFT 158 and settles to $V_{OLED}+V_T$ where $V_{OLED}$ is the voltage of the OLED 152, and $V_T$ is the threshold voltage of the drive TFT 158. During the programming cycle, i.e., the third operating cycle x63, node B6 is charged to $V_P+V_{REF}$ where $V_P$ is a programming voltage. It has been identified Thus the gate voltage of the drive TFT 158 becomes $V_{OLED}+V_T+V_P$. Here, the first storage capacitor 154 is used to store the $V_T+V_{OLED}$ during the compensation interval.

Figure 22:
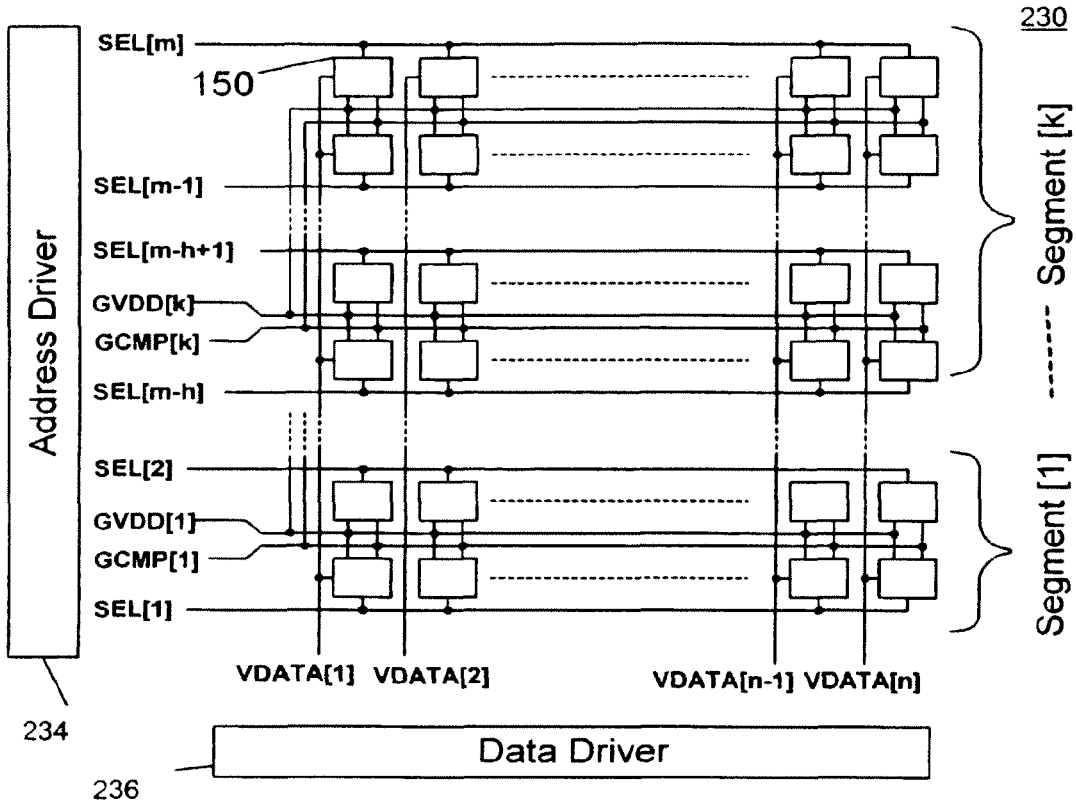
FIG. 22 illustrates an example of an AMOLED display array structure for the pixel circuit of FIG. 20.

FIG. 22 illustrates an example of an AMOLED display array structure for the pixel circuit 150 of FIG. 20. In FIG. 22, SEL[a] (a=1, . . . , m) corresponds to SEL of FIG. 22, GCMP [b] (b=1, . . . , K) corresponds to GCOMP of FIG. 22, GVDD [c] (c=1, . . . , k) corresponds to VDD of FIG. 22, and VDATA [d] (d=1, . . . , n) corresponds to VDATA of FIG. 22. The AMOLED display 230 of FIG. 22 includes a plurality of pixel circuits 150 which are arranged in row and column, an address driver 234 for controlling SEL[a], GCOMP[b], and GVDD[c], and a data driver 236 for controlling VDATA[c]. The rows of the pixel circuits 230 are segmented (e.g., segment [l] and segment [k]) as described above.

Referring to FIGS. 20 and 22, VDD and GCOMP signals of the rows in one segment are connected together and form GVDD and GCOMP lines. GVDD and GCOMP signals are shared in the segment. Moreover, GVDD and GCOMP in the same segment are merged together and form the segment GVDD and GCOMP lines. Thus, the controlling signals are reduced. Further, the number of blocks driving the signals is also reduced resulting in lower power consumption and lower implementation cost.

According to the embodiments of the present invention, the operating cycles are shared in a segment to generate an accurate threshold voltage of the drive TFT. It reduces the power consumption and signals, resulting in lower implementation cost. The operating cycles of a row in the segment are overlapped with the operating cycles of another row in the segment. Thus, they can maintain high display speed, regardless of the size of the display.

The accuracy of the generated VT depends on the time allocated to the $V_T$-generation cycle. The generated $V_T$ is a function of the storage capacitance and drive TFT parameters, as a result, the special mismatch affects the generated VT associated within the mismatch in the storage capacitor for a given threshold voltage of the drive transistor. Increasing the time of the $V_T$-generation cycle reduces the effect of special mismatch on the generated $V_T$. According to the embodiments of the present invention, the timing assigned to $V_T$ is extendable without either affecting the frame rate or reducing the number of rows, thus, it is capable of reducing the imperfect compensation and spatial mismatch effect, regardless of the size of the panel.

The $V_T$-generation time is increased to enable high-precision recovery of the threshold voltage $V_T$ of the drive TFT across its gate-source terminals. As a result, the uniformity over the panel is improved. In addition, the pixel circuits for the addressing schemes have the capability of providing a predictably higher current as the pixel ages and so as to compensate for the OLED luminance degradation.

According to the embodiments of the present invention, the addressing schemes improve the backplane stability, and also compensate for the OLED luminance degradation. The overhead in power consumption and implementation cost is reduced by over 90% compared to the existing compensation driving schemes.

Since the shared addressing scheme ensures the low power consumption, it is suitable for low power applications, such as mobile applications. The mobile applications may be, but not limited to, Personal Digital Assistants (PDAs), cell phones, etc.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A display system comprising:

a pixel array including a plurality of pixel circuits arranged in rows and columns, each pixel circuit having a light emitting device, a capacitor, a drive transistor for driving the light emitting device, a first switch transistor connected to a data line for programming the pixel circuit during a programming operation to cause programming data from the data line to be stored in the capacitor, and a second switch transistor for generating a threshold voltage of the drive transistor during a generating threshold voltage operation; and a driver configured to operate the second switch transistor to generate the threshold voltage of the drive transistor during the generating threshold voltage operation by operating the second switch transistor in a first pixel circuit in a first row of the pixel array while programming during the programming operation a second pixel circuit in a second row of the pixel array by operating the first switch transistor in the second pixel circuit, wherein the generating threshold voltage operation of the first pixel circuit has a duration greater than a row timing budget of the display system and pre-charges the first pixel circuit by resetting a node between the capacitor and a gate terminal of the drive transistor using an adjustable power supply to which the drive transistor is connected, wherein the pre-charging the first pixel circuit does not affect a data line associated with the first pixel circuit.

2. The display system as claimed in claim 1, wherein the driver is further configured to, after programming the second pixel circuit, program a third pixel circuit in a third row of the pixel array by operating the first switch transistor in the third pixel circuit while the generating threshold voltage operation is carried out in the first pixel circuit such that both the second pixel circuit and the third pixel circuit are programmed while the threshold voltage is generated in the first pixel circuit.

3. The display system as claimed in claim 1, wherein the first pixel circuit is pre-charged during a first phase of the generating threshold voltage operation, and by charging the threshold voltage of the respective drive transistors on the capacitor during a second phase of the generating threshold voltage operation, the second phase of the generating threshold voltage operation having a duration greater than a duration of the first phase.

4. The display system as claimed in claim 3, wherein the adjustable power supply pre-charges the capacitor to a negative voltage in each of the plurality of pixel circuits during the first phase of the generating threshold voltage operation.

5. The display system as claimed in claim 1, wherein the first pixel circuit and the second pixel circuit share a data line of the pixel array, and wherein the generating threshold voltage operation is carried out in the first pixel circuit without affecting the data line such that the programming of the second pixel circuit is independent of the generating threshold voltage operation in the first pixel circuit.

6. The display system as claimed in claim 1, wherein the pixel array is divided into a plurality of segments each including a subset of the pixel circuits in the pixel array, and wherein the driver is further configured to implement the generating threshold voltage operation in a first segment of the plurality of segments while a second segment is programmed with display data or driven to emit light.

7. A display system as claimed in claim 1, wherein the plurality of pixel circuits are each configured with a gate terminal of the first switch transistor being connected to a first select line, the gate terminal of the second switch transistor being connected to a second select line, the first and second select lines being driven by the driver, the first terminal of the second switch transistor being connected to a gate terminal of the drive transistor, a first terminal of the first switch transistor being connected to the data line, a second terminal of the first switch transistor being connected to the gate terminal of the drive transistor, the data line being driven by the driver, the capacitor being connected between the gate terminal of the drive transistor and the light emitting device.

8. A display system as claimed in claim 1, wherein the plurality of pixel circuits are each configured with the capacitor being a first capacitor, each of the plurality of pixel circuits further including a second capacitor and a third switch transistor, and wherein the plurality of pixel circuits are each configured with a gate terminal of the first switch transistor being connected to a first select line, gate terminals of the second and third switch transistors being connected to a second select line, the first and second select lines being driven by the driver, a first terminal of the first switch transistor being connected to the data line, a second terminal of the first switch transistor being connected to the first and second capacitors, a first terminal of the second switch transistor being connected to the first and second capacitors, a first terminal of the third switch transistor being connected to the drive transistor and the light emitting device, a second terminal of the third switch transistor being connected to a gate terminal of the drive transistor, the first and second capacitors being connected to the gate terminal of the drive transistor in series.

9. The display system of claim 1, wherein the driver is further configured to operate the second switch transistor in a fourth row next to the first row of the pixel array to generate the threshold voltage of the drive transistor of the pixel circuit in the fourth row such that the generating threshold voltage operation of the drive transistor in the first row partially overlaps the generating threshold voltage operation of the drive transistor in the fourth row.

10. A method of driving a display, the display comprising a pixel array including a plurality of pixel circuits arranged in rows and columns, each pixel circuit having a light emitting device, a capacitor, a drive transistor for driving the light emitting device to emit light, a first switch transistor connected to a data line for programming the pixel circuit during a programming operation in which programming data from the data line is stored in the capacitor, and a second switch transistor for generating a threshold voltage of the drive transistor, the method comprising:

generating a threshold voltage of a drive transistor in a first pixel circuit in a first row of the pixel array by controlling a second switch transistor in the first pixel circuit to generate the threshold voltage during a generating threshold voltage operation without affecting a data line associated with the first pixel circuit; and programming during the programming operation a second pixel circuit in a second row of the pixel array by controlling the first switch transistor in the second pixel circuit to program the second pixel circuit via the data line associated with the first pixel circuit, the programming being carried out while the threshold voltage of the first pixel circuit is being generated, and wherein the generating the threshold voltage has a duration greater than a row timing budget of the display and wherein the generating the threshold voltage includes:

pre-charging the capacitor of the first pixel circuit with an initial voltage during a first phase to reset a voltage at the gate of the drive transistor, and developing the threshold voltage of the drive transistor on the capacitor during a second phase by charging or discharging the initial voltage through the drive transistor, and wherein the second phase has a duration greater than a programming timing budget of the display.

11. The method as claimed in claim 10, further comprising:

programming a third pixel circuit in a third row of the pixel array by operating a first switch transistor in the third pixel circuit to program the third pixel circuit via the data line associated with the first pixel circuit, the programming the third pixel circuit being carried out while the threshold voltage of the first pixel circuit is being generated such that both the second pixel circuit and the third pixel circuit are programmed while the threshold voltage is generated in the first pixel circuit.

12. The method as claimed in claim 10, wherein the generating the threshold voltage includes:

pre-charging a capacitor of the first pixel circuit with an initial voltage during a first phase, and developing the threshold voltage of the drive transistor on the capacitor during a second phase by charging or discharging the initial voltage through the drive transistor, and wherein the second phase has a duration greater than a programming timing budget of the display.

13. The method as claimed in claim 10, wherein the precharging is carried out by adjusting a voltage of a controllable power supply line.

14. The method as claimed in claim 10, wherein the pixel array is divided into a plurality of segments each including a subset of the plurality of pixel circuits in the pixel array, the pixel circuits in the first row of the pixel array being included in a first segment of the plurality of segments and pixel circuits in the second row of the pixel array being included in a second segment of the plurality of segments, and wherein the respective second switch transistors in the pixel circuits in the first segment are each controlled by a shared first global select line and the respective second switch transistors in the pixel circuits in the second segment are each controlled by a shared second global select line, and wherein the generating the threshold voltage of the first pixel circuit is carried out by operating the first global select line to simultaneously generate respective threshold voltages of the respective drive transistors in the plurality of pixel circuits in the first segment.

15. The method as claimed in claim 14, further comprising:

driving the plurality of pixels in the second segment to emit light while the generating the threshold voltages of the plurality of pixels in the first segment is carried out simultaneously.

16. A pixel circuit for a display, the pixel circuit including:

a light emitting device;

a drive transistor for driving the light emitting device by controlling the current flowing through the light emitting device;

a first and second capacitor coupled in series between a controllable power supply line and a gate terminal of the drive transistor, the controllable power supply line being coupled to a first terminal of the drive transistor, the second terminal of the drive transistor being coupled to the light emitting device;

a first switch transistor operated according to a first select line for programming the pixel circuit by coupling a data line to a node between the first and second capacitors, the first and second capacitors and the first switch transistor being connected to the node; and a second switch transistor coupled to the gate terminal of the drive transistor for generating a threshold voltage of the drive transistor during a generating threshold voltage operation that precedes a programming operation wherein a programming voltage is provided on the data line, wherein during the programming operation the second switch transistor is off thereby charging the gate of the drive transistor to a voltage corresponding to at least the threshold voltage of the drive transistor and the programming voltage, wherein the second switch transistor is operated according to a global select line shared by a plurality of similar pixel circuits, the plurality of similar pixel circuits simultaneously generating threshold voltages of the respective drive transistors during the generating threshold voltage operation in the plurality of similar pixel circuits according to the global select line, the plurality of similar pixel circuits including pixel circuits in more than one row of the display.

17. The pixel circuit as claimed in claim 16, wherein the second switch transistor is coupled between the gate terminal of the drive transistor and the light emitting device, the second terminal of the drive transistor being coupled to the light emitting device.

18. The pixel circuit as claimed in claim 16, wherein the plurality of pixel circuits sharing the global select line is a subset of similar pixel circuits arranged in a pixel array having rows and columns, the pixel array being divided into a plurality of segments, each of the plurality of segments including a subset of the plurality of similar pixel circuits in more than one row of the pixel array, and wherein the second switch transistors in each segment of the plurality of segments are operated by global select lines shared by the pixel circuits in each segment.

19. The pixel circuit as claimed in claim 16, wherein the second switch transistor is coupled between the gate terminal of the drive transistor and a first terminal of the drive transistor, the second terminal of the drive transistor being connected to the light emitting device, the pixel circuit further comprising:

a third switch transistor coupled between the first terminal of the drive transistor and a power supply line.

20. The pixel circuit as claimed in claim 19, wherein the plurality of similar pixel circuits sharing the global select line to simultaneously generate threshold voltages includes pixel circuits from multiple rows and multiple columns of a pixel array.

* * * * *